US011927356B2

(12) United States Patent
Kato et al.

(10) Patent No.: US 11,927,356 B2
(45) Date of Patent: Mar. 12, 2024

(54) CONTROLLER OF AIR CONDITIONING APPARATUS, OUTDOOR UNIT, BRANCH UNIT, HEAT SOURCE UNIT, AND AIR CONDITIONING APPARATUS

(71) Applicant: Mitsubishi Electric Corporation, Tokyo (JP)

(72) Inventors: Naoki Kato, Tokyo (JP); Yuji Motomura, Tokyo (JP); Kimitaka Kadowaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 412 days.

(21) Appl. No.: 17/432,677

(22) PCT Filed: Apr. 18, 2019

(86) PCT No.: PCT/JP2019/016662
§ 371 (c)(1),
(2) Date: Aug. 20, 2021

(87) PCT Pub. No.: WO2020/213130
PCT Pub. Date: Oct. 22, 2020

(65) Prior Publication Data

US 2022/0090812 A1 Mar. 24, 2022

(51) Int. Cl.
*F24F 11/63* (2018.01)
*F24F 3/06* (2006.01)
(Continued)

(52) U.S. Cl.
CPC ..... *F24F 11/63* (2018.01); *F24F 3/06* (2013.01); *F24F 11/43* (2018.01); *F25B 30/02* (2013.01);
(Continued)

(58) Field of Classification Search
CPC ..... F24F 11/43; F25B 2313/0233; F25B 2313/02332; F25B 2313/0231
See application file for complete search history.

(56) References Cited

U.S. PATENT DOCUMENTS 5,784,893 A 7/1998 Furuhama et al.
2011/0146339 A1 6/2011 Yamashita et al.
(Continued)

FOREIGN PATENT DOCUMENTS

CN 1117568 A 2/1996
CN 103797317 A 5/2014
(Continued)

OTHER PUBLICATIONS

Office Action dated Jun. 2, 2022 issued in corresponding CN Patent Application No. 201980095347.X.
(Continued)

*Primary Examiner* — Nelson J Nieves
(74) *Attorney, Agent, or Firm* — POSZ LAW GROUP, PLC

(57) ABSTRACT

An air conditioning apparatus includes a plurality of third heat exchangers and flow rate control valves. In a heating mode, a controller opens a flow rate control valve corresponding to a heat exchanger that is being requested to perform air conditioning of the plurality of third heat exchangers, and closes a flow rate control valve corresponding to a heat exchanger that is not being requested to perform air conditioning of the plurality of third heat exchangers. In a defrosting mode, when a temperature of a second heat medium is lower than a first determination temperature, the controller opens a flow rate control valve corresponding to at least one of the heat exchangers that are not being requested to perform air conditioning. The at least one of the heat exchangers is assigned a higher priority than a remain-
(Continued)

<DURING HEATING-DEFROSTING (STATE A)> ing heat exchanger that is not being requested to perform air conditioning.

12 Claims, 19 Drawing Sheets

(51) Int. Cl.
*F24F 11/43* (2018.01)
*F25B 30/02* (2006.01)
*F24F 110/10* (2018.01)
*F24F 140/20* (2018.01)

(52) U.S. Cl.
CPC ..... *F24F 2110/10* (2018.01); *F24F 2140/20* (2018.01)

(56) References Cited

U.S. PATENT DOCUMENTS

2012/0297812 A1* 11/2012 Takata ..... F25B 25/005 62/324.6
2012/0304675 A1* 12/2012 Motomura ..... F24F 11/89 62/156
2013/0192284 A1* 8/2013 Kawai ..... F25B 43/043 62/156
2014/0096551 A1* 4/2014 Morimoto ..... F25B 49/02 62/129
2014/0196483 A1 7/2014 Okazaki
2014/0216083 A1* 8/2014 Morimoto ..... F25B 29/003 62/238.7
2015/0075192 A1* 3/2015 Wasa ..... F24F 11/42 62/80
2015/0300714 A1* 10/2015 Ishimura ..... F25B 49/02 62/228.1
2015/0330674 A1* 11/2015 Yamashita ..... F25B 13/00 62/160
2015/0369498 A1* 12/2015 Motomura ..... F25B 49/02 62/160
2020/0208890 A1* 7/2020 Zhuo ..... F25B 13/00
2020/0355415 A1* 11/2020 Yanachi ..... F25B 13/00
2021/0190402 A1* 6/2021 Washiyama ..... F25B 25/005

FOREIGN PATENT DOCUMENTS

CN 109458699 A 3/2019
EP 2618074 B1 * 11/2017 ..... F25B 13/00
EP 3 922 918 A1 12/2021
JP S58-195758 A 11/1983
JP H08-049936 A 2/1996
JP 2842471 B2 1/1999
JP 2000-002474 A 1/2000
JP 2009-041860 A 2/2009
JP 2009198099 A * 9/2009
JP 5791717 B2 * 10/2015 ..... F25B 13/00
WO 2010/050003 A1 5/2010
WO WO-2013164936 A1 * 11/2013 ..... F24F 11/0034
WO WO-2017085859 A1 * 5/2017 ..... F24F 11/89

OTHER PUBLICATIONS

Office Action dated Apr. 18, 2023 issued in corresponding European Patent Application No. 19925041.6.
Extended European Search Report dated Mar. 7, 2022 in corresponding EP Patent Application No. 19925041.6.
International Search Report of the International Searching Authority dated Jun. 18, 2019 for the corresponding International application No. PCT/JP2019/016662 (and English translation).
Office Action dated Sep. 13, 2022 issued in corresponding JP Patent Application No. 2021-514749 (and English machine translation).

* cited by examiner

<DURING HEATING OPERATION>

<DURING HEATING-DEFROSTING (STATE A)>

<DURING HEATING-DEFROSTING (STATE B)>

FIG.12

| | INDOOR UNIT No. | | |
|---|---|---|---|
| | 30 | 40 | 50 |
| SUNDAY | 2.3 | 1.8 | 3.5 |
| MONDAY | 1.2 | 0.9 | 2.8 |
| TUESDAY | 0.9 | 1.5 | 3.0 |
| ⋮ | | | |

[hr/day]

CONTROLLER OF AIR CONDITIONING APPARATUS, OUTDOOR UNIT, BRANCH UNIT, HEAT SOURCE UNIT, AND AIR CONDITIONING APPARATUS

CROSS REFERENCE TO RELATED APPLICATION

This application is a U.S. national stage application of International Application PCT/JP2019/016662 filed on Apr. 18, 2019, the contents of which are incorporated herein by reference.

TECHNICAL FIELD

The present disclosure relates to a controller of an air conditioning apparatus, an outdoor unit, a branch unit, a heat source unit, and an air conditioning apparatus.

BACKGROUND

Conventionally, an indirect air conditioning apparatus is known that generates hot and/or cold water by a heat source unit such as a heat pump, and delivers the water to an indoor unit through a water pump and a pipe to perform heating and/or cooling in the interior of a room.

Such an indirect air conditioning apparatus uses water or brine as a use-side heat medium, and thus has been receiving increasing attention in recent years in order to reduce refrigerant usage.

In an air conditioning apparatus disclosed in Japanese Patent Laying-Open No. 2009-41860, when a water heat exchanger for generating hot and/or cold water is likely to freeze, a bypass circuit is opened and an expansion valve is closed, causing low-temperature refrigerant during defrosting to bypass, and not to flow into, the water heat exchanger, to prevent the freezing of the water heat exchanger.

PATENT LITERATURE

PTL 1: Japanese Patent Laying-Open No. 2009-41860

In a configuration that prevents refrigerant from flowing through a water heat exchanger acting as an evaporator during defrosting by means of a bypass circuit, as in Japanese Patent Laying-Open No. 2009-41860, heat absorption from water to the refrigerant at the water heat exchanger does not take place, resulting in a longer defrosting time. This causes a longer interruption time of heating and thus reduces room temperature, possibly resulting in compromised comfort.

SUMMARY

The present disclosure has been made to solve the problem described above, and has an object to provide a controller, of an indirect air conditioning apparatus using a heat medium such as water or brine, which is capable of ensuring heat absorption from the heat medium while preventing freezing of the heat medium, thereby reducing the amount of time required for defrosting operation.

The present disclosure relates to a controller that controls an air conditioning apparatus configured to operate in operation modes including a heating mode and a defrosting mode. The air conditioning apparatus includes: a compressor configured to compress a first heat medium; a first heat exchanger configured to perform heat exchange between the first heat medium and outdoor air; a second heat exchanger configured to perform heat exchange between the first heat medium and a second heat medium; a plurality of third heat exchangers each configured to perform heat exchange between the second heat medium and indoor air; a plurality of flow rate control valves each configured to control a flow rate of the second heat medium flowing through a corresponding one of the plurality of third heat exchangers; and a pump configured to circulate the second heat medium between the plurality of third heat exchangers and the second heat exchanger. In the heating mode, the controller is configured to open a flow rate control valve corresponding to a heat exchanger that is being requested to perform air conditioning of the plurality of third heat exchangers, and to close a flow rate control valve corresponding to a heat exchanger that is not being requested to perform air conditioning of the plurality of third heat exchangers. In the defrosting mode, when a temperature of the second heat medium is lower than a first determination temperature, the controller is configured to open a flow rate control valve corresponding to at least one of the heat exchangers that are not being requested to perform air conditioning. The at least one of the heat exchangers is assigned a higher priority than a remaining heat exchanger that is not being requested to perform air conditioning.

According to the controller of the present disclosure, a defrosting time of the air conditioning apparatus is shortened, and accordingly, comfort during air conditioning is improved.

BRIEF DESCRIPTION OF DRAWINGS

FIG. 12 is a diagram for illustrating determination of priorities based on frequency of use.

DETAILED DESCRIPTION

Figure 1:
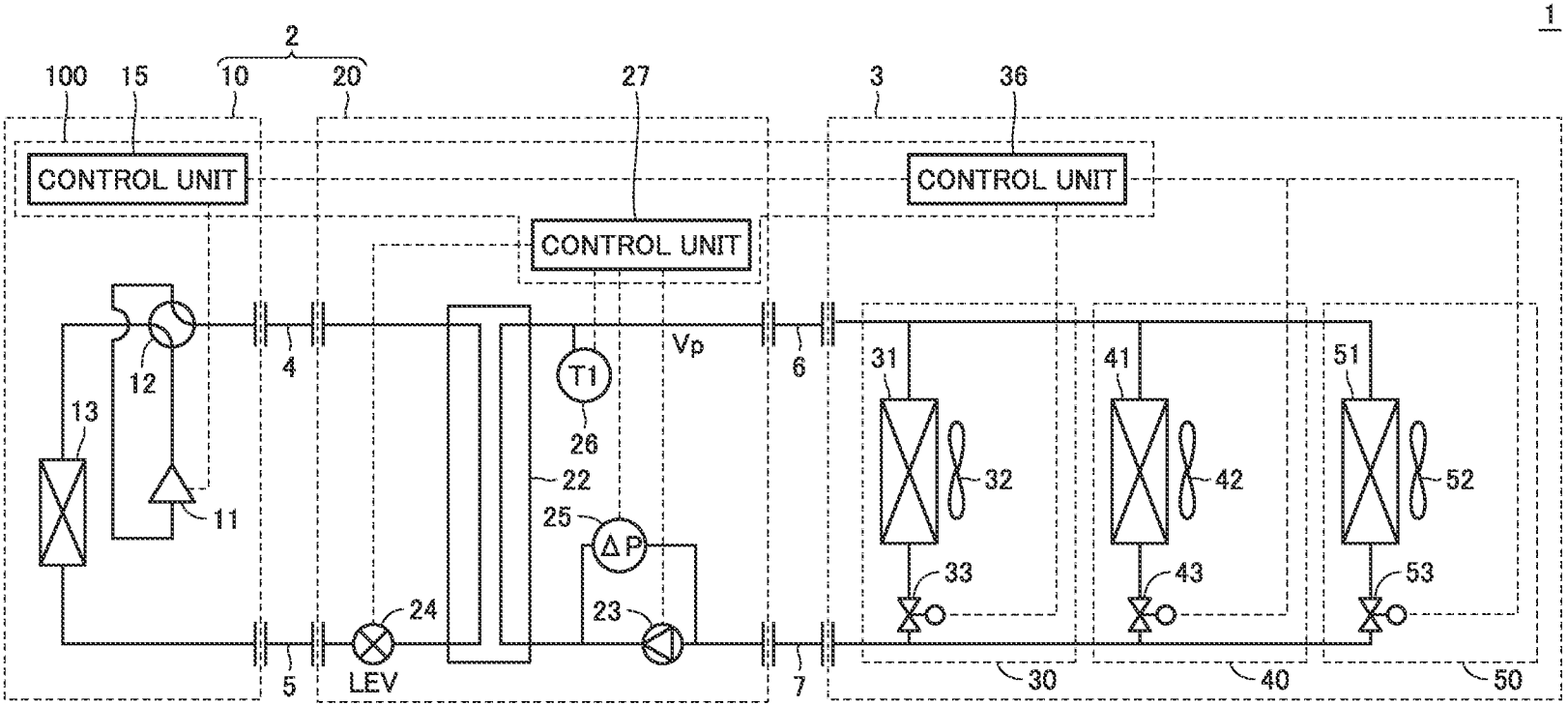
FIG. 1 is a diagram showing the configuration of an air conditioning apparatus according to a first embodiment.

In the following, embodiments of the present disclosure will be described in detail with reference to the drawings. While a plurality of embodiments are described below, it has been intended from the time of filing of the present application to appropriately combine configurations described in the respective embodiments. Note that the same or corresponding portions are designated by the same symbols in the drawings and will not be described repeatedly.

First Embodiment

FIG. 1 is a diagram showing the configuration of an air conditioning apparatus according to a first embodiment. Referring to FIG. 1, an air conditioning apparatus 1 includes a heat source unit 2, an indoor air conditioning device 3, and a controller 100. Heat source unit 2 includes an outdoor unit 10 and a branch unit 20. In the following description, a first heat medium can be exemplified by refrigerant, and a second heat medium can be exemplified by water or brine.

Outdoor unit 10 includes part of a refrigeration cycle that operates as a heat source or a cold source for the first heat medium. Outdoor unit 10 includes a compressor 11, a four-way valve 12, and a first heat exchanger 13. FIG. 1 shows an example where four-way valve 12 performs cooling or defrosting, with heat source unit 2 serving as a cold source. When four-way valve 12 is switched to reverse the direction of circulation of the refrigerant, heating is performed, with heat source unit 2 serving as a heat source.

Branch unit 20 includes a second heat exchanger 22, a pump 23 for circulating the second heat medium between branch unit 20 and indoor air conditioning device 3, an expansion valve 24, a pressure sensor 25 for detecting a differential pressure $\Delta P$ before and after pump 23, and a temperature sensor 26 for measuring a temperature of the second heat medium that has passed through second heat exchanger 22. Second heat exchanger 22 performs heat exchange between the first heat medium and the second heat medium. A plate heat exchanger can be used as second heat exchanger 22.

Outdoor unit 10 and branch unit 20 are connected to each other by pipes 4 and 5 for flowing the first heat medium. Compressor 11, four-way valve 12, first heat exchanger 13, expansion valve 24, and second heat exchanger 22 form a first heat medium circuit which is a refrigeration cycle using the first heat medium. Outdoor unit 10 and branch unit 20 may be integrated together in heat source unit 2. If they are integrated together, pipes 4 and 5 are accommodated in a casing.

Indoor air conditioning device 3 and branch unit 20 are connected to each other by pipes 6 and 7 for flowing the second heat medium. Indoor air conditioning device 3 includes an indoor unit 30, an indoor unit 40 and an indoor unit 50. Indoor units 30, 40 and 50 are connected in parallel with one another between pipe 6 and pipe 7.

Indoor unit 30 includes a heat exchanger 31, a fan 32 for delivering indoor air to heat exchanger 31, and a flow rate control valve 33 for controlling a flow rate of the second heat medium. Heat exchanger 31 performs heat exchange between the second heat medium and the indoor air.

Indoor unit 40 includes a heat exchanger 41, a fan 42 for delivering indoor air to heat exchanger 41, and a flow rate control valve 43 for controlling a flow rate of the second heat medium. Heat exchanger 41 performs heat exchange between the second heat medium and the indoor air.

Indoor unit 50 includes a heat exchanger 51, a fan 52 for delivering indoor air to heat exchanger 51, and a flow rate control valve 53 for controlling a flow rate of the second heat medium. Heat exchanger 51 performs heat exchange between the second heat medium and the indoor air.

Pump 23, second heat exchanger 22, and parallel-connected heat exchanger 31, heat exchanger 41 and heat exchanger 51 form a second heat medium circuit using the second heat medium. While an air conditioning apparatus having three indoor units is illustrated by way of example in the present embodiment, any number of indoor units may be provided.

Control units 15, 27 and 36 distributed across outdoor unit 10, branch unit 20 and indoor air conditioning device 3 cooperate with one another to operate as controller 100. Controller 100 controls compressor 11, expansion valve 24, pump 23, flow rate control valves 33, 43, 53, and fans 32, 42, 52 in response to outputs from pressure sensor 25 and temperature sensor 26.

One of control units 15, 27 and 36 may serve as a controller, and control compressor 11, expansion valve 24, pump 23, flow rate control valves 33, 43, 53, and fans 32, 42, 52 based on data detected by the other control units 15, 27 and 36. If heat source unit 2 has outdoor unit 10 and branch unit 20 that are integrated together, control units 15 and 27 may cooperate with each other to operate as a controller based on data detected by control unit 36.

In the configuration of FIG. 1, air conditioning apparatus 1 determines, using temperature sensor 26, whether or not the second heat medium is likely to freeze. When the second heat medium is likely to freeze during defrosting, the flow rate control valves are opened and the fans are rotated in the indoor units to introduce heat from indoor air into the second heat medium, to prevent the freezing. This freezing-preventing operation will be sequentially described below.

Figure 2:
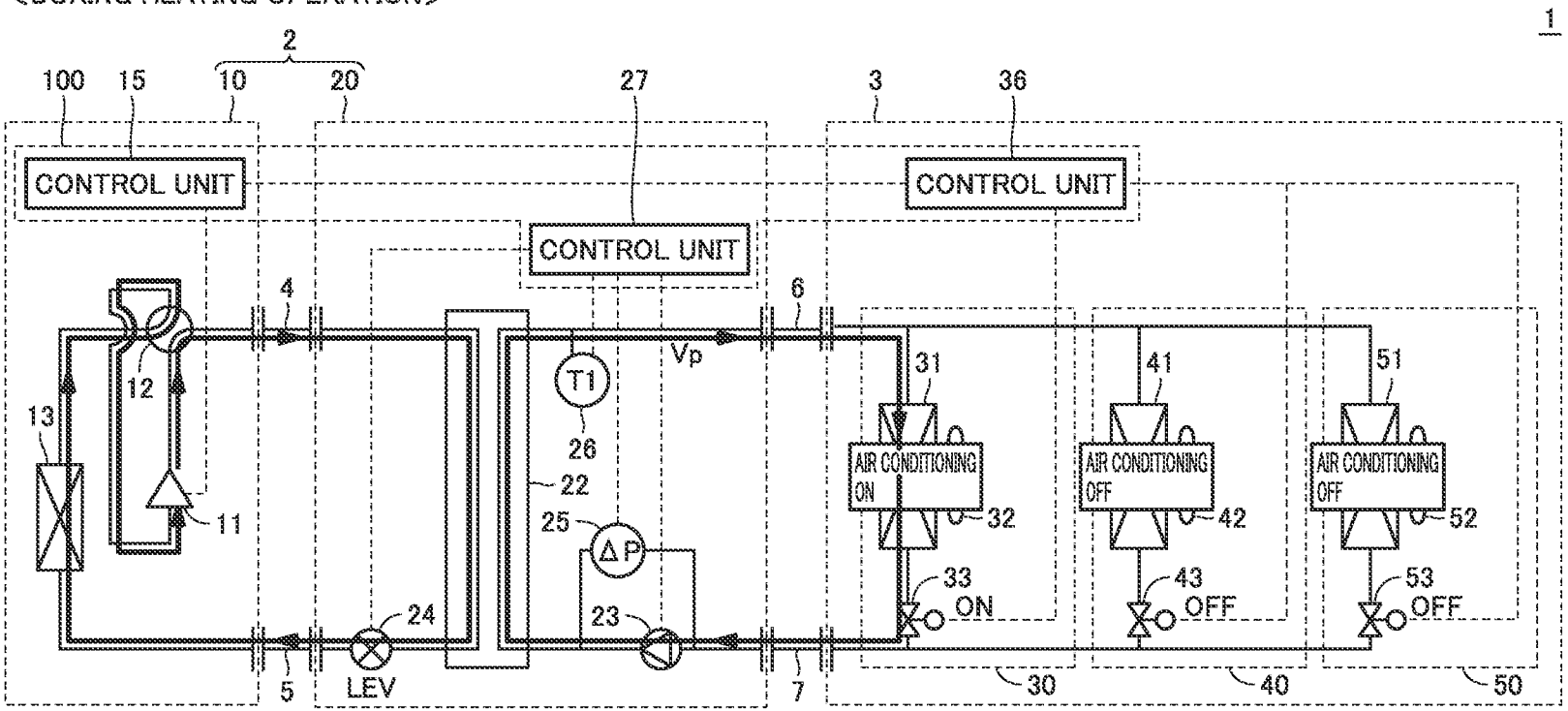
FIG. 2 is a diagram showing flows of a first heat medium and a second heat medium during heating operation.

For ease of explanation, an example where indoor units 40 and 50 are in a stopped state and only indoor unit 30 is performing heating operation is initially described. FIG. 2 is a diagram showing flows of the first heat medium and the second heat medium during the heating operation. In FIG. 2, indoor unit 30 is described as being in an air-conditioning ON state, and indoor units 40 and 50 are described as being in an air-conditioning OFF state. The air-conditioning ON state indicates a state in which the indoor unit is being requested to perform air conditioning, and the air-conditioning OFF state indicates a state in which the indoor unit is not being requested to perform air conditioning. The air-conditioning OFF state includes a situation where the indoor unit has been turned off with a remote controller or the like, and also a situation where room temperature has reached a set temperature as a result of air conditioning by the indoor unit in the air-conditioning ON state, and the air conditioning is being suspended.

During the heating operation, four-way valve 12 is set such that the first heat medium (refrigerant) is discharged from compressor 11, passes successively through second heat exchanger 22, expansion valve 24 and first heat exchanger 13, and returns to compressor 11. The high-temperature and high-pressure first heat medium discharged from compressor 11 performs heat exchange with the second heat medium at second heat exchanger 22 and is thereby condensed. The condensed first heat medium is decompressed by expansion valve 24, evaporates into a low-temperature gaseous state at first heat exchanger 13, and returns to compressor 11.

In the second heat medium circuit, the second heat medium (water or brine) delivered from pump 23 performs heat exchange with the first heat medium at second heat exchanger 22 and thereby increases in temperature. The second heat medium having the increased temperature is supplied to indoor unit 30 in the air-conditioning ON state, and performs heat exchange with indoor air. Indoor unit 30 in the air-conditioning ON state thereby supplies hot air into the room. Flow rate control valve 33 corresponding to indoor unit 30 in the air-conditioning ON state is controlled to be in an open state, and flow rate control valves 43 and 53 corresponding to indoor units 40 and 50 in the air-conditioning OFF state are controlled to be in a closed state. Thus, the second heat medium flows through heat exchanger 31, but does not flow through heat exchangers 41 and 51.

Figure 3:
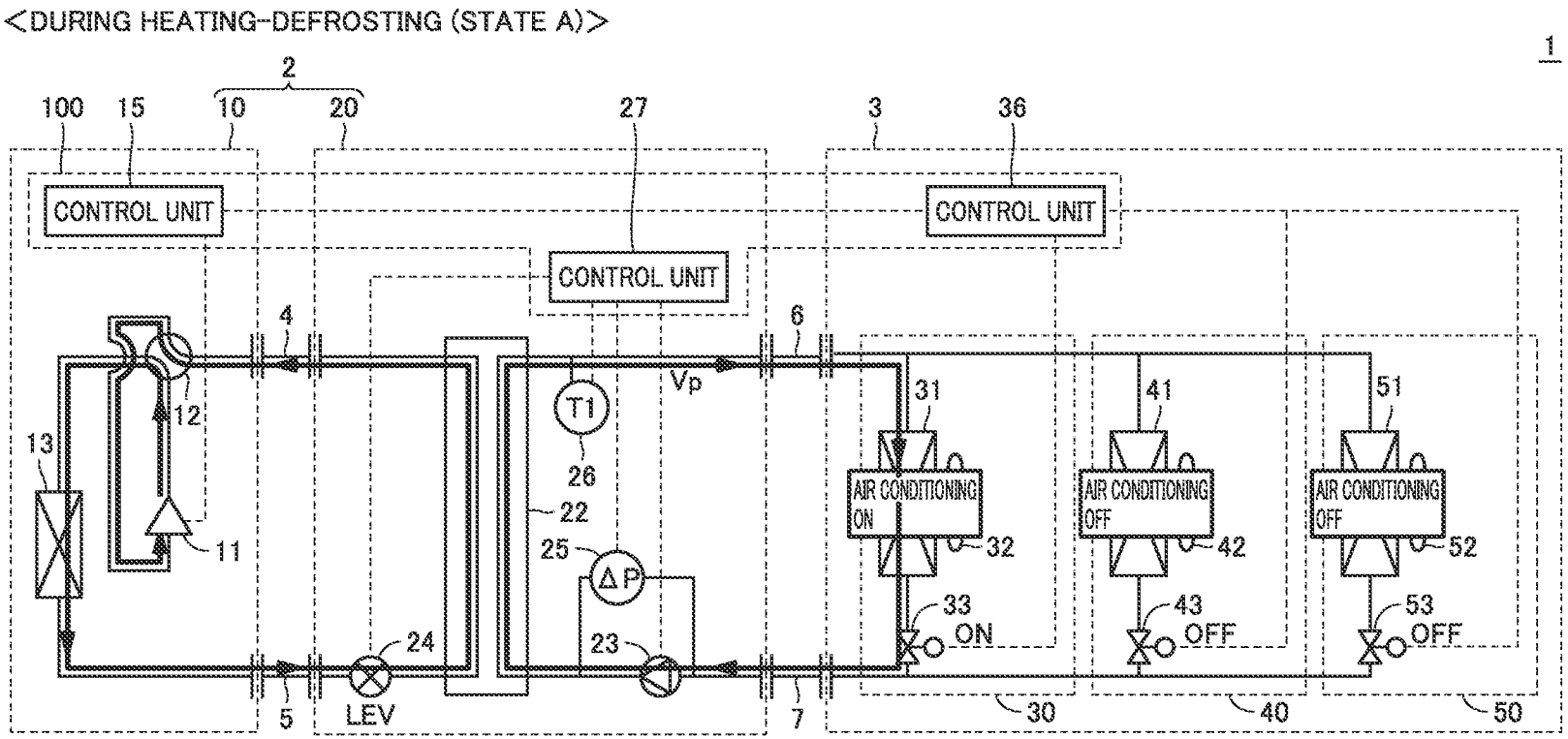
FIG. 3 is a diagram showing flows of the first heat medium and the second heat medium in heating-defrosting operation (state A).

FIG. 3 is a diagram showing flows of the first heat medium and the second heat medium in heating-defrosting operation (state A). The heating-defrosting operation (state A) is a normal state of heating-defrosting operation. Referring to FIG. 3, four-way valve 12 is set such that the first heat medium (refrigerant) is discharged from compressor 11, passes successively through first heat exchanger 13, expansion valve 24 and second heat exchanger 22, and returns to compressor 11. That is, four-way valve 12 is controlled to be in the same state as that in cooling operation. At this time, the high-temperature and high-pressure first heat medium discharged from compressor 11 performs heat exchange with outdoor air at first heat exchanger 13 and is thereby condensed. The condensed first heat medium is decompressed by expansion valve 24, performs heat exchange with the second heat medium and turns into a low-temperature gaseous state at second heat exchanger 22, and returns to compressor 11.

In the second heat medium circuit, the second heat medium (water or brine) delivered from pump 23 performs heat exchange with the first heat medium at second heat exchanger 22 and thereby decreases in temperature. The second heat medium having the reduced temperature is supplied to indoor unit 30 in the air-conditioning ON state. However, fan 32 is in a stopped state, and therefore, cold air is not blown into the room. Flow rate control valve 33 corresponding to indoor unit 30 in the air-conditioning ON state is controlled to be in an open state, and flow rate control valves 43 and 53 corresponding to indoor units 40 and 50 in the air-conditioning OFF state are controlled to be in a closed state. Thus, the second heat medium flows through heat exchanger 31, but does not flow through heat exchangers 41 and 51.

At this time, at second heat exchanger 22, the second heat medium performs heat exchange with the low-temperature first heat medium and is thereby cooled. When the temperature of the second heat medium at a flow-in portion of second heat exchanger 22 is low, the second heat medium is likely to freeze within second heat exchanger 22.

Figure 4:
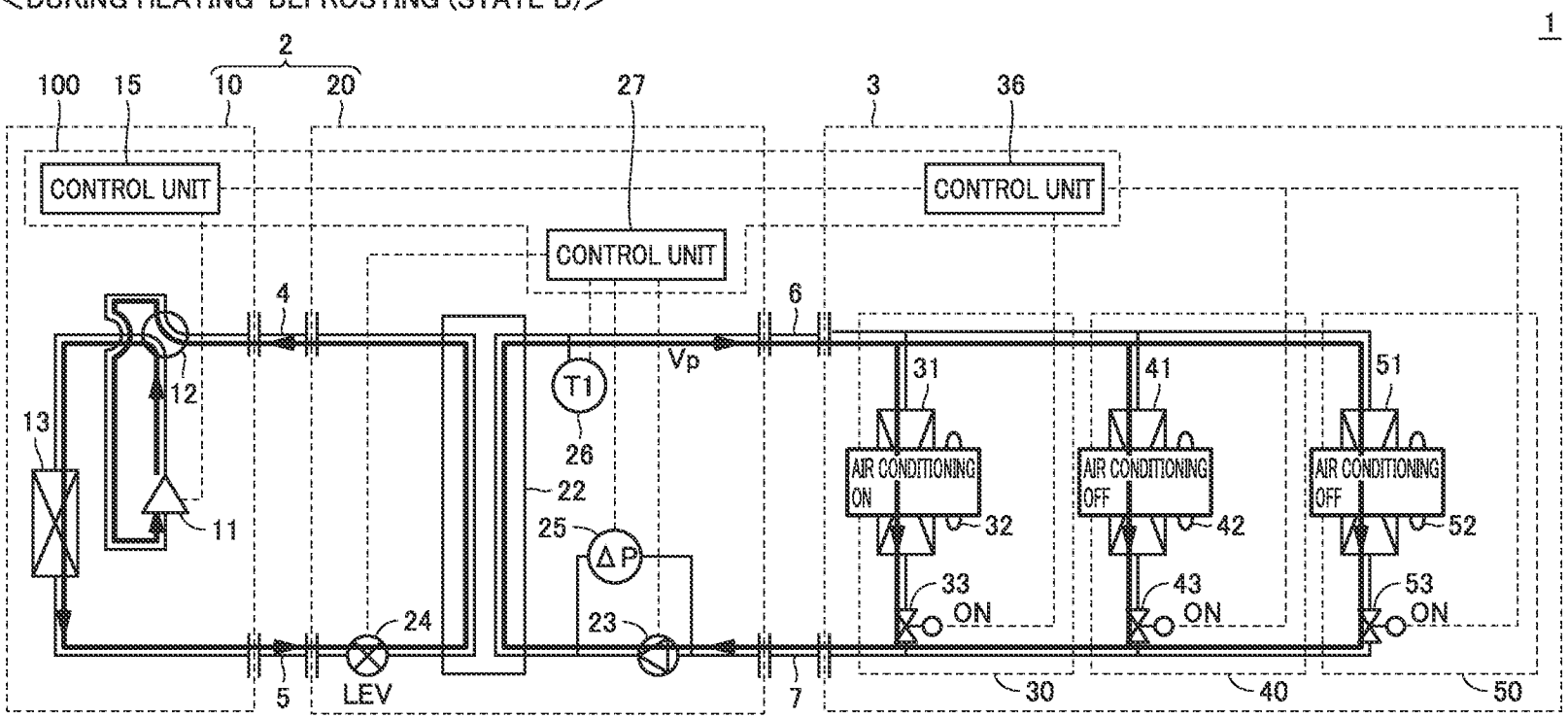
FIG. 4 is a diagram showing flows of the first heat medium and the second heat medium in heating-defrosting operation (state B).

FIG. 4 is a diagram showing flows of the first heat medium and the second heat medium in heating-defrosting operation (state B). The heating-defrosting operation (state B) is a state in which the temperature of the second heat medium has decreased during the defrosting operation. FIG. 4 is different from FIG. 3 in that, during the heating-defrosting operation, the second heat medium is also flowed through the heat exchangers in the air-conditioning OFF state, to absorb heat from the air in rooms in which the indoor units in the air-conditioning OFF state are installed. A path of circulation of the first heat medium is the same as that of FIG. 3. Thus, the second heat medium circuit in FIG. 4 is described.

Referring to FIG. 4, in the second heat medium circuit, the second heat medium (water or brine) delivered from pump 23 performs heat exchange with the first heat medium at second heat exchanger 22 and thereby decreases in temperature. The second heat medium having the reduced temperature is supplied to indoor unit 30 in the air-conditioning ON state. However, fan 32 is in a stopped state, and therefore, cold air is not blown into the room.

In addition, the temperature of the second heat medium is monitored by temperature sensor 26, and when the temperature of the second heat medium reaches a first determination temperature X° C. close to a freezing temperature, the settings of flow rate control valves 43 and 53 corresponding to indoor units 40 and 50 in the air-conditioning OFF state are changed from the closed state to the open state. Fans 42 and 52 are also simultaneously driven, to actively perform heat exchange between the indoor air and the second heat medium at heat exchangers 41 and 51. As a result, the second heat medium increases in temperature, and is thus prevented from freezing. Therefore, the freezing at second heat exchanger 22 is prevented, and a defrosting time is shortened because the defrosting operation does not need to be interrupted.

When the temperature of the second heat medium that has decreased once increases to a second determination temperature Y° C., the path of circulation of the second heat medium is set again as in FIG. 3, and the defrosting operation is continued. Second determination temperature Y° C. may be any temperature higher than or equal to first determination temperature X° C. While second determination temperature Y° C. may be the same temperature as first determination temperature X° C., it is preferred to set Y>X to avoid frequent occurrence of switching of the flow path.

Figure 5:
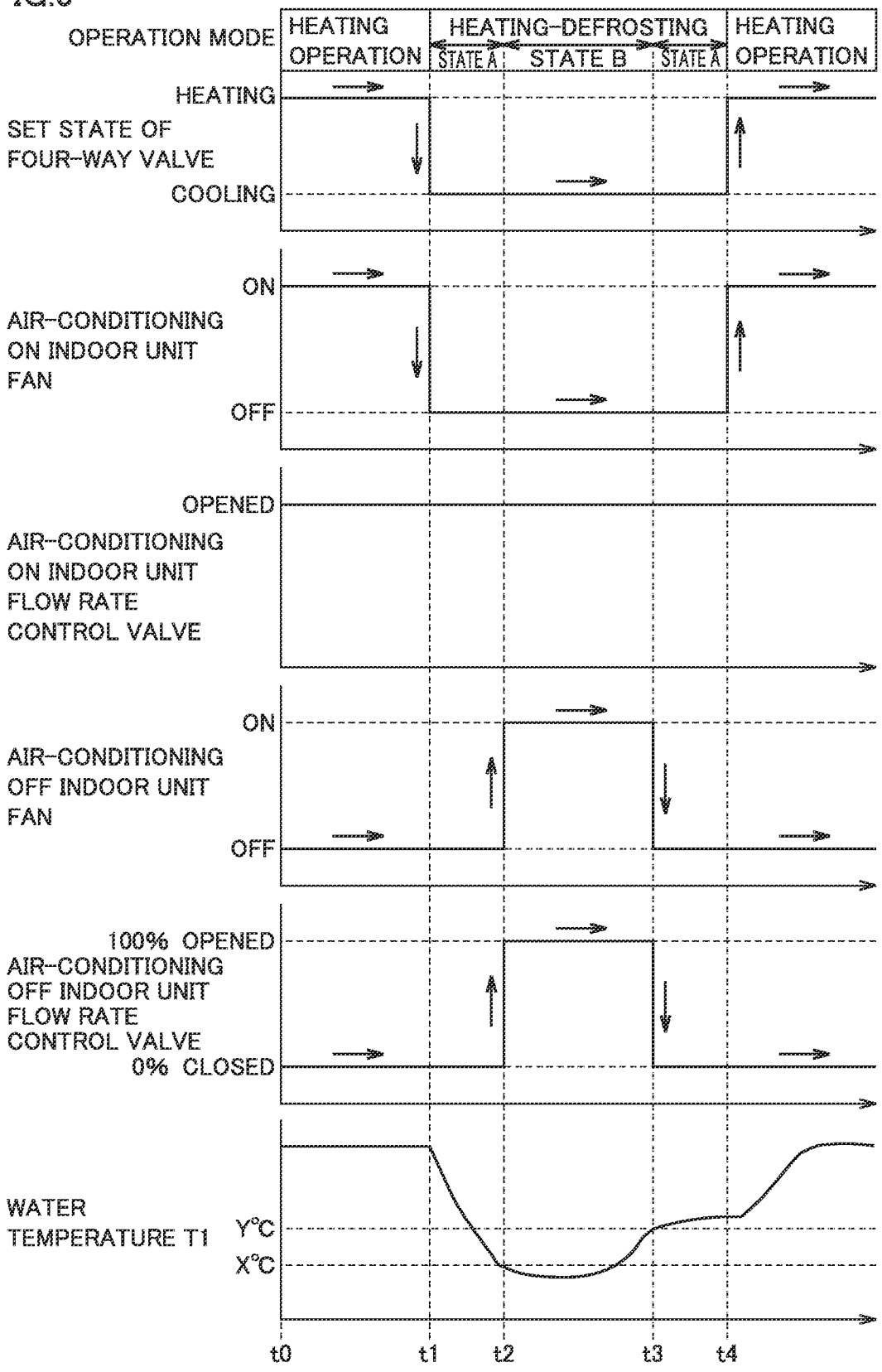
FIG. 5 shows waveform diagrams for illustrating exemplary control of heating-defrosting operation in the first embodiment.

FIG. 5 shows waveform diagrams for illustrating exemplary control of the heating-defrosting operation in the first embodiment. Between times t0 and t1 in FIG. 5, heating operation is performed, and the first heat medium and the second heat medium flow as shown in FIG. 2.

At time t1, in response to a heating-defrosting start condition being satisfied, the state of the four-way valve is set from a heating state to a cooling state. Between times t1 and t2, the first heat medium and the second heat medium flow as shown in state A of FIG. 3. The heat of the second heat medium is transferred to the first heat medium at second heat exchanger 22, causing the temperature of the second heat medium to decrease gradually, and fall below first determination temperature X° C. at time t2.

In response to this, between times t2 and t3, the flow of the second heat medium is changed such that the second heat medium also flows through the air-conditioning OFF indoor units as shown in state B of FIG. 4. The indoor air and the second heat medium thereby exchange a greater amount of heat with each other, causing the temperature of the second heat medium to increase gradually.

When the temperature of the second heat medium becomes higher than second determination temperature Y° C. at time t3, the settings of the flow rate control valves are changed again as shown in FIG. 3. Then, when a defrosting operation stop condition is satisfied at time t4, a return is made again to the heating operation as shown in FIG. 2.

Figure 6:
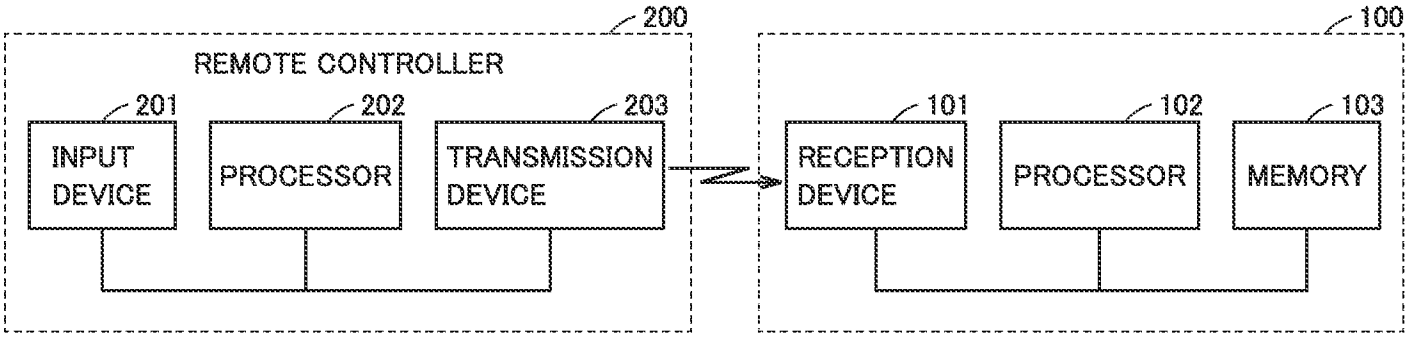
FIG. 6 is a diagram showing the configurations of a controller for controlling the air conditioning apparatus and of a remote controller for remotely controlling the controller.

FIG. 6 is a diagram showing the configurations of the controller for controlling the air conditioning apparatus and of a remote controller for remotely controlling the controller. Referring to FIG. 6, a remote controller 200 includes an input device 201, a processor 202, and a transmission device 203. Input device 201 includes a push button through which the user switches an indoor unit between ON and OFF, a button through which the user enters a set temperature, and the like. Transmission device 203 is for communicating with controller 100. Processor 202 controls transmission device 203 in accordance with an input signal provided from input device 201.

Controller 100 includes a reception device 101, a processor 102, and a memory 103.

Memory 103 includes, for example, a ROM (Read Only Memory), a RAM (Random Access Memory), and a flash memory. The flash memory stores an operating system, an application program, and various types of data.

Processor 102 controls overall operation of air conditioning apparatus 1. Controller 100 shown in FIG. 1 is implemented by processor 102 executing the operating system and the application program stored in memory 103. The various types of data stored in memory 103 are referred to during the execution of the application program. Reception device 101 is for communicating with remote controller 200. When there are a plurality of indoor units, reception device 101 is provided in each of the plurality of indoor units.

When the controller is divided into a plurality of control units as shown in FIG. 1, the processor is included in each of the plurality of control units. In such a case, the plurality of processors cooperate with one another to perform overall control of air conditioning apparatus 1. Such controller 100 may be included in any of outdoor unit 10, indoor air conditioning device 3, branch unit 20, heat source unit 2, and air conditioning apparatus 1.

Figure 7:
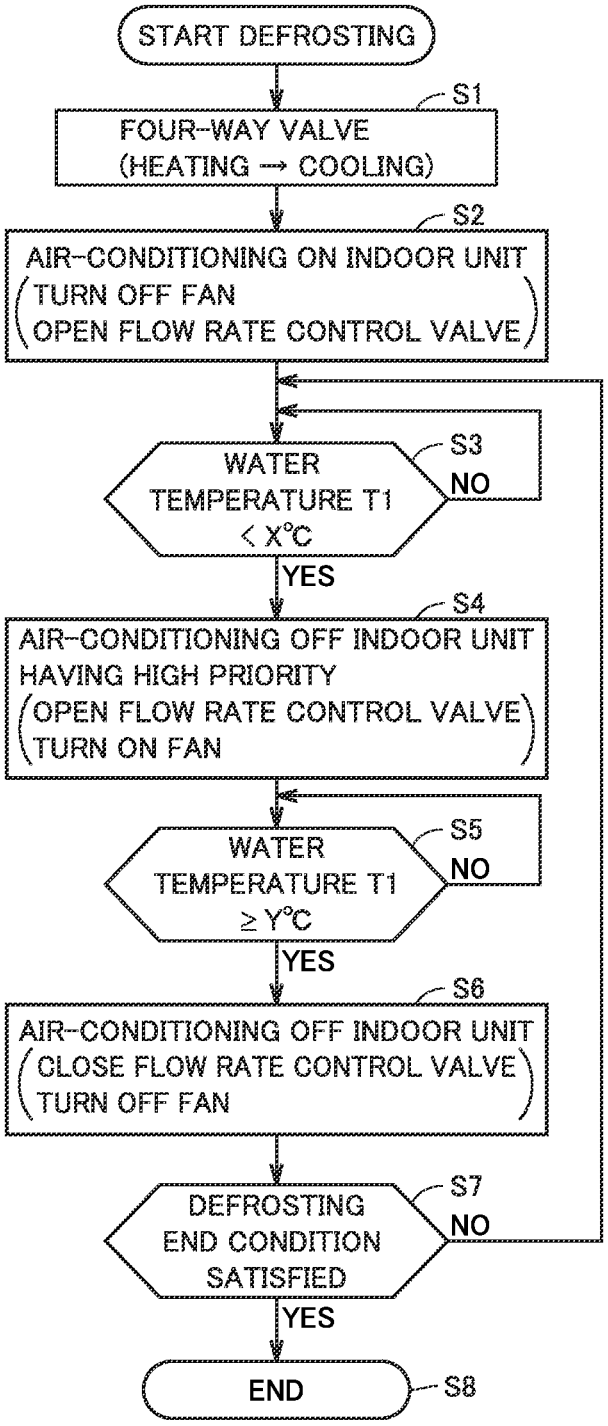
FIG. 7 is a flowchart for illustrating control performed by the controller in the first embodiment.

FIG. 7 is a flowchart for illustrating control performed by the controller in the first embodiment. Referring to FIG. 7, defrosting operation is started when a predetermined defrosting start condition is satisfied. The defrosting start condition is satisfied, for example, each time a certain time elapses, or when the formation of frost on the heat exchanger of the outdoor unit is detected, during heating operation.

When the defrosting operation is started, first in step S1, controller 100 switches four-way valve 12 from a heating operation state to a cooling operation state. Subsequently, in step S2, controller 100 controls an indoor unit in the air-conditioning ON state such that its fan is turned off and its flow rate control valve is opened. This causes the second heat medium to flow as shown in state A of FIG. 3, for example.

In this state, in step S3, controller 100 determines whether or not a temperature T1 of the second heat medium detected at temperature sensor 26 is lower than first determination temperature X° C. When temperature T1 is higher than or equal to first determination temperature X° C. (NO in S3), state A of the defrosting operation shown in FIG. 3 is maintained. When temperature T1 is lower than first determination temperature X° C. (YES in S3), on the other hand, the process proceeds to step S4.

In step S4, controller 100 controls indoor units in the air-conditioning OFF state such that their flow rate control valves are opened and their fans are turned on. This causes the second heat medium to flow as shown in state B of FIG. 4, for example.

In step S4, the flow rate control valves corresponding to all of the indoor units in the air-conditioning OFF state may be opened as shown in FIG. 4. It is preferred, however, to set priorities in advance, and to open a flow rate control valve corresponding to at least one of the indoor units in the air-conditioning OFF state that has a high priority. As a result, indoor units in the air-conditioning OFF state that are affected by the defrosting can be limited to at least one of the indoor units, which is advantageous for operation when the state is changed from the air-conditioning OFF state to the air-conditioning ON state.

In this state, in step S5, controller 100 determines whether or not temperature T1 of the second heat medium detected at temperature sensor 26 is higher than or equal to second determination temperature Y° C. When temperature T1 is lower than second determination temperature Y° C. (NO in S5), state B of the defrosting operation shown in FIG. 4 is maintained. When temperature T1 is higher than or equal to second determination temperature Y° C. (YES in S5), on the other hand, the process proceeds to step S6.

In step S6, controller 100 controls the indoor units in the air-conditioning OFF state such that their flow rate control valves are closed and their fans are turned off. This causes the flow of the second heat medium to return to original state A as shown in FIG. 3.

In subsequent step S7, controller 100 determines whether or not a defrosting end condition is satisfied. The defrosting end condition is satisfied, for example, when a certain time has elapsed since the start of the defrosting, or when the defrosting of the outdoor unit is completed. When the defrosting end condition is not satisfied in step S7, the processes of step S3 and the subsequent steps are repeated again. When the defrosting end condition is satisfied in step S7, on the other hand, the defrosting operation ends in step S8, and the heating operation is performed again.

Referring back to FIG. 1, the configuration and main operation of the air conditioning apparatus and the controller in the first embodiment are described. Controller 100 is a controller to control air conditioning apparatus 1 that operates in operation modes including a heating mode and a defrosting mode. Air conditioning apparatus 1 includes compressor 11 to compress the first heat medium, first heat exchanger 13 to perform heat exchange between the first heat medium and outdoor air, second heat exchanger 22 to perform heat exchange between the first heat medium and the second heat medium, the plurality of third heat exchangers 31, 41 and 51 to perform heat exchange between the second heat medium and indoor air, the plurality of flow rate control valves 33, 43 and 53 to control the flow rates of the second heat medium flowing through the plurality of third heat exchangers 31, 41 and 51, respectively, and pump 23 to circulate the second heat medium between the plurality of third heat exchangers 31, 41, 51 and second heat exchanger 22.

In the heating mode, controller 100 opens a flow rate control valve corresponding to a heat exchanger that is being requested to perform air conditioning of the plurality of third heat exchangers 31, 41 and 51, and closes flow rate control valves corresponding to heat exchangers that are not being requested to perform air conditioning of the plurality of third heat exchangers 31, 41 and 51. In the defrosting mode, when temperature T1 of the second heat medium is lower than first determination temperature X° C. (YES in S3), controller 100 opens a flow rate control valve corresponding to at least one of the heat exchangers that are not being requested to perform air conditioning. The at least one of the heat exchangers is assigned a higher priority than a remaining heat exchanger that is not being requested to perform air conditioning. The at least one of the flow rate control valves having a higher priority is typically a flow rate control valve having the highest priority. If there are three, four or more heat exchangers that are not being requested to perform air conditioning, however, the at least one of the flow rate control valves may be two, three or more flow rate control valves in descending order of priority.

Preferably, in the defrosting mode, when temperature T1 of the second heat medium is higher than second determination temperature Y° C. (YES in S5), controller 100 closes the flow rate control valve corresponding to the heat exchanger that is not being requested to perform air conditioning.

In this manner, when the temperature of the second heat medium decreases during the defrosting operation, the second heat medium is flowed through the heat exchanger that is not being requested to perform air conditioning. This allows heat transfer from the indoor air to the second heat medium, thus increasing the temperature of the second heat medium.

As shown in FIG. 5, preferably, air conditioning apparatus 1 further includes a plurality of fans 32, 42 and 52 provided to correspond to the plurality of third heat exchangers 31, 41 and 51, respectively. In the heating mode, controller 100 drives a fan corresponding to a heat exchanger that is being requested to perform air conditioning, and stops a fan corresponding to a heat exchanger that is not being requested to perform air conditioning. In the defrosting mode, when the temperature of the second heat medium is lower than first determination temperature X° C., controller 100 drives a fan corresponding to the heat exchanger that is not being requested to perform air conditioning.

As shown in FIG. 5, preferably, in the defrosting mode, when the temperature of the second heat medium is higher than second determination temperature Y° C., controller 100 stops the fan corresponding to the heat exchanger that is not being requested to perform air conditioning.

In this manner, when the temperature of the second heat medium decreases during the defrosting operation, air is blown by the fan into the heat exchanger that is not being requested to perform air conditioning. This further facilitates the heat transfer from the indoor air to the second heat medium.

As described above, when the second heat medium is likely to freeze during the heating-defrosting, the air conditioning apparatus in the first embodiment opens a flow rate control valve and rotates a fan in an indoor unit in the air-conditioning OFF state, to increase the temperature of the second heat medium by indoor heat. Accordingly, heat absorption at the second heat exchanger can be ensured while the freezing at the second heat medium circuit is prevented, leading to a reduced amount of time required for defrosting operation.

Second Embodiment

In the first embodiment, the indoor units in the air-conditioning OFF state are collectively handled, or are employed as heat extraction sources in descending order of predetermined priority. In a second embodiment, a higher priority is assigned as room temperature is higher, in order to allow heat extraction in a short period of time in defrosting operation.

Figure 8:
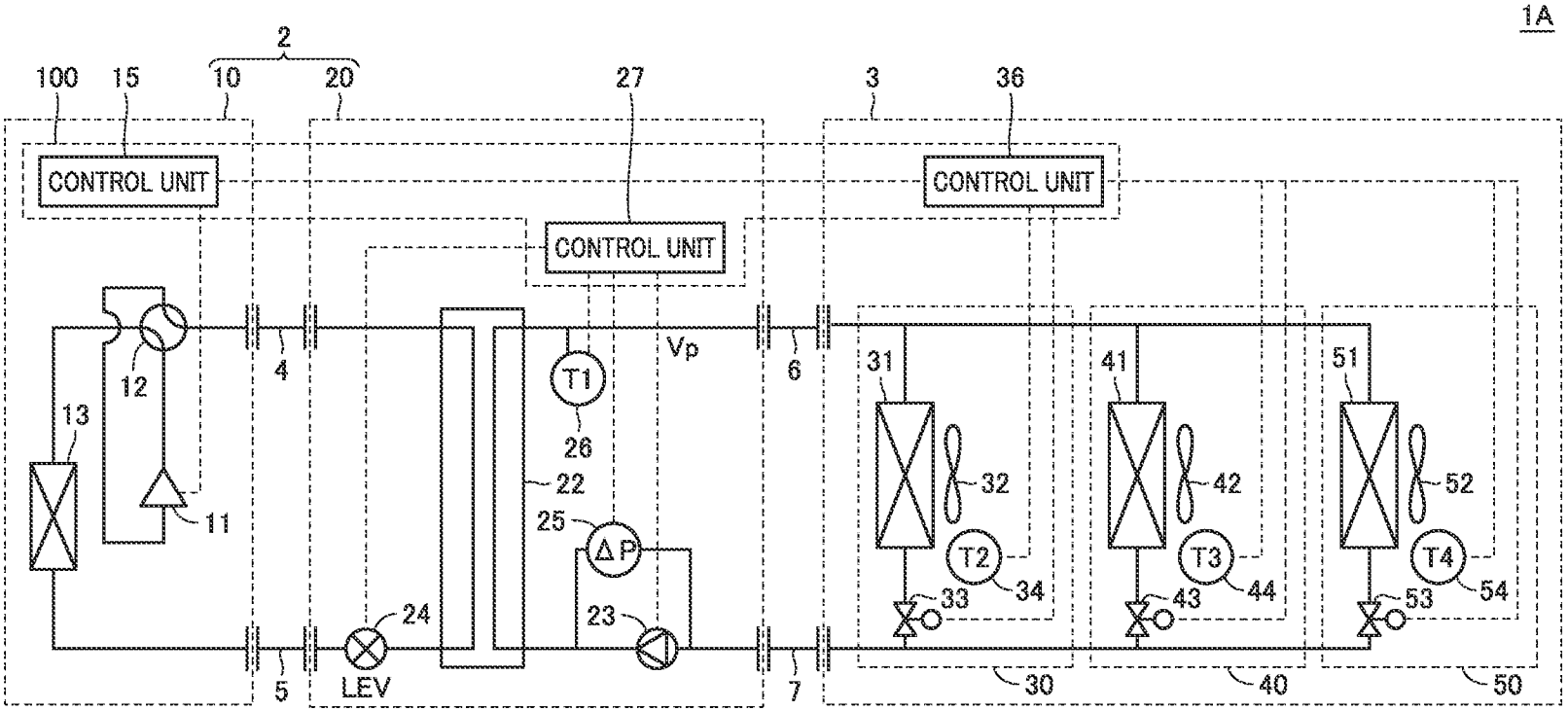
FIG. 8 is a diagram showing the configuration of an air conditioning apparatus in a second embodiment.

FIG. 8 is a diagram showing the configuration of an air conditioning apparatus 1A in the second embodiment. Air conditioning apparatus 1A shown in FIG. 8 further includes, in addition to the configuration of air conditioning apparatus 1 shown in FIG. 1, a plurality of room temperature sensors 34, 44 and 54 installed at the locations where the plurality of third heat exchangers 31, 41 and 51 are installed, respectively.

Indoor units 30, 40 and 50 include room temperature sensors 34, 44 and 54 to measure temperatures of indoor air, respectively. The configuration of air conditioning apparatus 1A is otherwise similar to that of air conditioning apparatus 1 shown in FIG. 1, and is not described repeatedly.

Room temperature sensors 34, 44 and 54 measure temperatures T2, T3 and T4 of indoor air in which the second heat medium performs heat exchange at third heat exchangers 31, 41 and 51, respectively, and output the temperatures to controller 100.

Controller 100 assigns a higher priority to flow rate control valve 33, 43 and 53 as the temperature detected by a corresponding one of the plurality of room temperature sensors 34, 44 and 54 is higher.

When the second heat medium is likely to freeze, controller 100 performs freezing-preventing operation of opening the flow rate control valve and turning on the indoor fan preferentially from an indoor unit having a higher room temperature of the indoor units in the air-conditioning OFF state. The higher the room temperature, the more advantageous the indoor unit as a heat source for heating the second heat medium. When employing any one of the indoor units as a heat extraction source, for example, selection of an indoor unit installed in a room having the highest room temperature allows an increase in temperature of the second heat medium in a short period of time.

Figure 9:
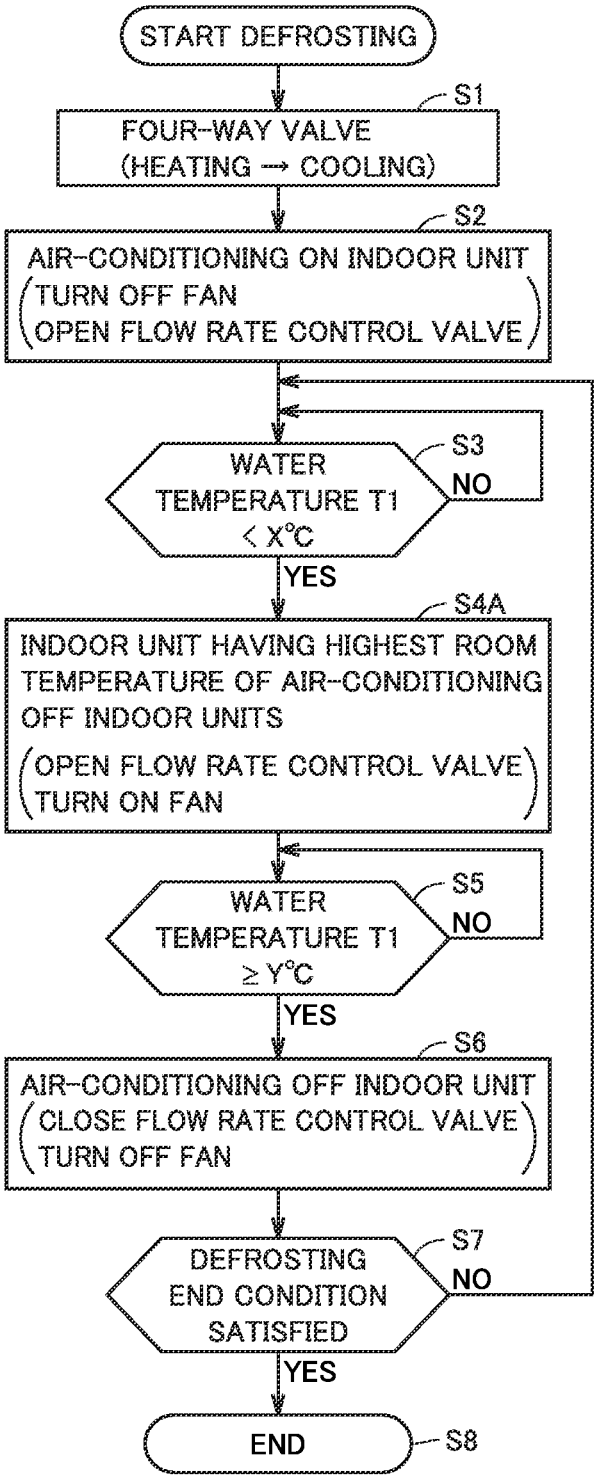
FIG. 9 is a flowchart for illustrating control performed by the controller in the second embodiment.

FIG. 9 is a flowchart for illustrating control performed by the controller in the second embodiment. In the flowchart shown in FIG. 9, step S4 in the flowchart illustrating the control of the first embodiment shown in FIG. 7 is replaced by step S4A. Therefore, description other than step S4A has been given in the first embodiment, and is thus not repeated here.

When water temperature T1 falls below X° C. during defrosting operation (YES in S3), in step S4A, controller 100 controls an indoor unit having the highest room temperature of the indoor units in the air-conditioning OFF state, such that its flow rate control valve is opened and its fan is turned on. This causes a change in the second heat medium, from flowing through both indoor units 40 and 50 in state B of FIG. 4, for example, to flowing through only one of them having a higher room temperature.

As a result, when indoor units in the air-conditioning OFF state that are affected by the defrosting are limited to at least one of the indoor units, heat can be preferentially extracted from an indoor space from which a higher amount of heat is extracted per unit time, leading to a reduced amount of time required for heat extraction.

Third Embodiment

In the second embodiment, the priorities are set depending on the room temperatures of the rooms in which the third heat exchangers are installed. In a third embodiment, controller 100 assigns a higher priority to a flow rate control valve as a capacity (capability) of a corresponding one of the plurality of third heat exchangers 31, 41 and 51 is higher.

Figure 10:
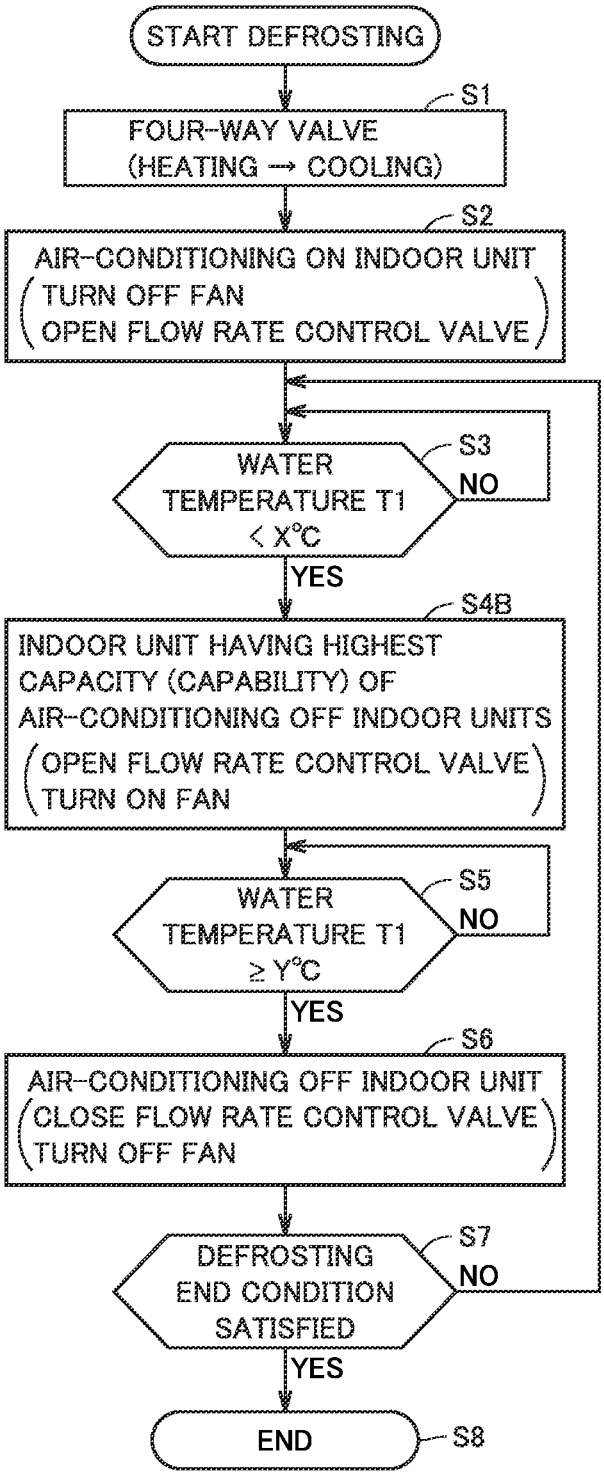
FIG. 10 is a flowchart for illustrating control performed by the controller in a third embodiment.

FIG. 10 is a flowchart for illustrating control performed by the controller in the third embodiment. In the flowchart shown in FIG. 10, step S4 in the flowchart illustrating the control of the first embodiment shown in FIG. 7 is replaced by step S4B. Therefore, description other than step S4B has been given in the first embodiment, and is thus not repeated here.

When water temperature T1 falls below X° C. during defrosting operation (YES in S3), in step S4B, controller 100 controls an indoor unit having the highest capacity of the indoor units in the air-conditioning OFF state, such that its flow rate control valve is opened and its fan is turned on. This causes a change in the second heat medium, from flowing through both indoor units 40 and 50 in state B of FIG. 4, for example, to flowing through only one of them having a higher capacity.

As a result, when indoor units in the air-conditioning OFF state that are affected by the defrosting are limited to at least one of the indoor units, heat can be preferentially extracted from a heat exchanger having a higher capability of heat extraction per unit time, leading to a reduced amount of time required for heat extraction.

Fourth Embodiment

In the second and third embodiments, when limiting the indoor heat exchangers serving as heat extraction sources, a flow rate control valve corresponding to an indoor heat exchanger that can reduce the amount of time required for heat extraction is preferentially selected. In contrast, in a fourth embodiment, an indoor heat exchanger with a lower frequency of use of the indoor units in the air-conditioning OFF state is preferentially employed as a heat extraction source.

Figure 11:
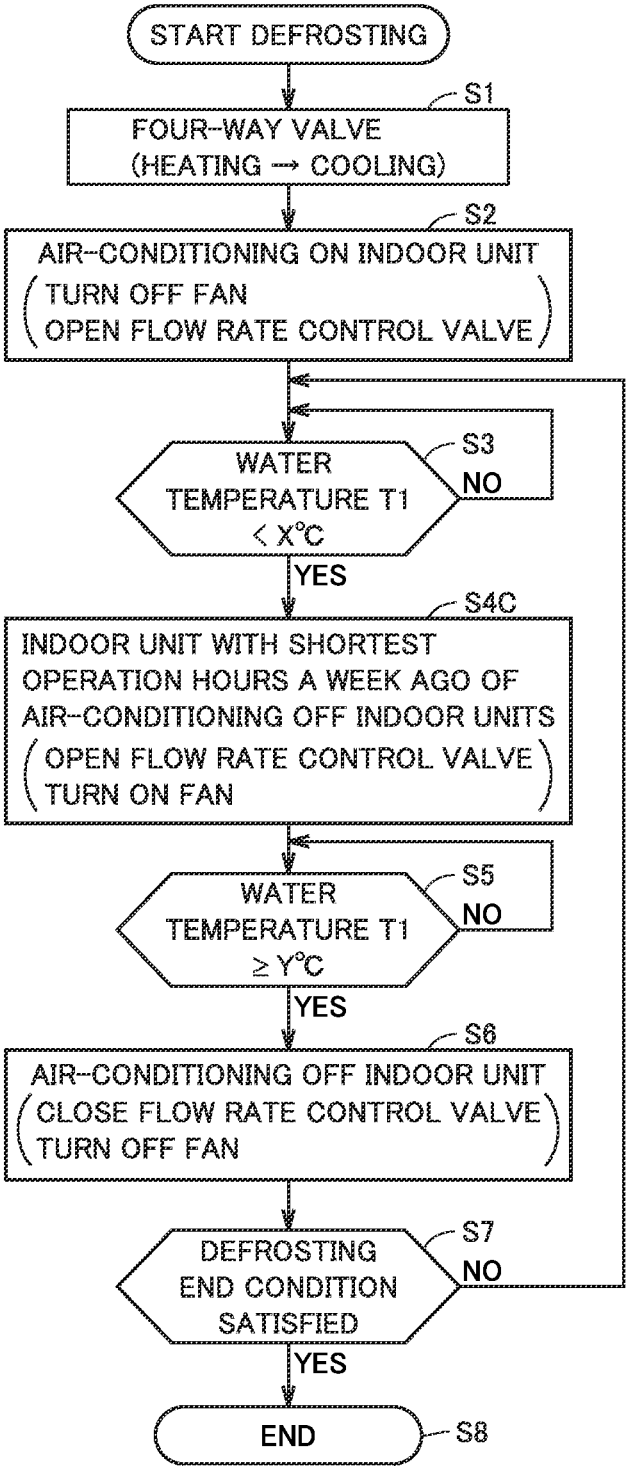
FIG. 11 is a flowchart for illustrating control performed by the controller in a fourth embodiment.

FIG. 11 is a flowchart for illustrating control performed by the controller in the fourth embodiment. In the flowchart shown in FIG. 11, step S4 in the flowchart illustrating the control of the first embodiment shown in FIG. 7 is replaced by step S4C. Therefore, description other than step S4C has been given in the first embodiment, and is thus not repeated here.

When water temperature T1 falls below X° C. during defrosting operation (YES in S3), in step S4C, controller 100 controls an indoor unit with the shortest operation hours per day a week ago of the indoor units in the air-conditioning OFF state, such that its flow rate control valve is opened and its fan is turned on. This causes a change in the second heat medium, from flowing through both indoor units 40 and 50 in state B of FIG. 4, for example, to flowing through only one of them with a lower frequency of use.

FIG. 12 is a diagram for illustrating determination of priorities based on frequency of use. Controller 100 measures operation hours per day (hr/day) for each indoor unit, and stores measured data for each day of the week.

As shown in FIG. 12, the operation hours on Sunday are stored as 2.3 hours, 1.8 hours and 3.5 hours for indoor units 30, 40 and 50, respectively. Therefore, a higher priority is assigned as the operation hours are shorter. For Sunday, indoor unit 40 with the shortest 1.8 hours of operation has the highest priority.

The operation hours on Monday are stored as 1.2 hours, 0.9 hours and 2.8 hours for indoor units 30, 40 and 50, respectively. Therefore, a higher priority is assigned as the operation hours are shorter. For Monday, indoor unit 40 with the shortest 0.9 hours of operation has the highest priority.

The operation hours on Tuesday are stored as 0.9 hours, 1.5 hours and 3.0 hours for indoor units 30, 40 and 50, respectively. Therefore, a higher priority is assigned as the operation hours are shorter. For Tuesday, indoor unit 30 with the shortest 0.9 hours of operation has the highest priority.

For the subsequent Wednesday through Saturday, the operation hours are similarly recorded and the priorities of the indoor units are set.

In step S4C of FIG. 11, therefore, the operation hours on the same day of the previous week shown in FIG. 12 are referred to, and a flow rate control valve of an indoor unit with the shortest operation hours on a corresponding day of the week of the air-conditioning OFF indoor units is opened.

As described above, in the fourth embodiment, as shown in FIGS. 11 and 12, controller 100 assigns a higher priority to a flow rate control valve as the operation hours of a corresponding one of the plurality of third heat exchangers during a certain period of time prior to the present time are shorter.

The certain period of time prior to the present time may be the previous day, one month ago, and the like. More specifically, as shown in FIG. 12, controller 100 assigns a higher priority to a flow rate control valve as its corresponding operation hours per day on the same day of the week as the present day of the week are shorter.

As a result, when indoor units in the air-conditioning OFF state that are affected by the defrosting are limited to at least one of the indoor units, the effect of the heat extracting operation on the user can be minimized.

Fifth Embodiment

In the fourth embodiment, an indoor unit with a lower frequency of use in the past of the indoor units in the air-conditioning OFF state is preferentially employed as a heat extraction source. However, even if the frequency of use is low, the heat extracting operation may compromise the user's comfort if the user is using the indoor unit at that moment. In a fifth embodiment, therefore, each indoor unit is provided with a human detection sensor for checking the presence of the user in the room, and an indoor unit to serve as a heat extraction source is determined based on an output from the sensor.

Figure 13:
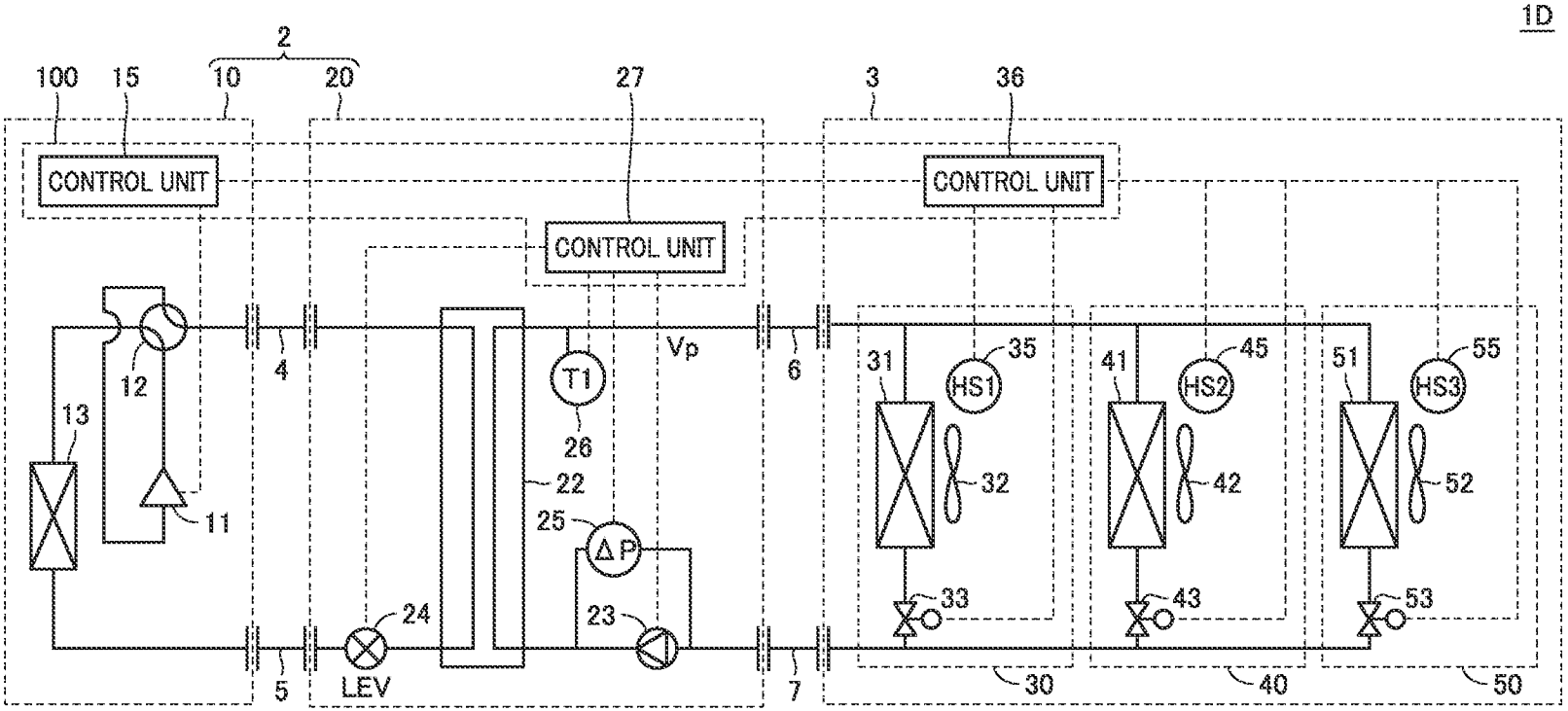
FIG. 13 is a diagram showing the configuration of an air conditioning apparatus in a fifth embodiment.

FIG. 13 is a diagram showing the configuration of an air conditioning apparatus 1D in the fifth embodiment. Air conditioning apparatus 1D shown in FIG. 13 further includes, in addition to the configuration of air conditioning apparatus 1 shown in FIG. 1, a plurality of human detection sensors 35, 45 and 55 for detecting whether or not the user is present at the locations where the plurality of third heat exchangers 31, 41 and 51 are installed. As human detection sensors 35, 45 and 55, various types of human detection sensors such as infrared-, ultrasound-, and visible light-based sensors can be used.

Indoor units 30, 40 and 50 may include human detection sensors 35, 45 and 55, or the human detection sensors may be installed at a distance from the indoor units as long as they are in the same room as the indoor units. The configuration of air conditioning apparatus 1D is otherwise similar to that of air conditioning apparatus 1 shown in FIG. 1, and is not described repeatedly.

Human detection sensors 35, 45 and 55 detect whether or not the user is present in the rooms where third heat exchangers 31, 41 and 51 are installed, respectively, and output results to controller 100.

Figure 14:
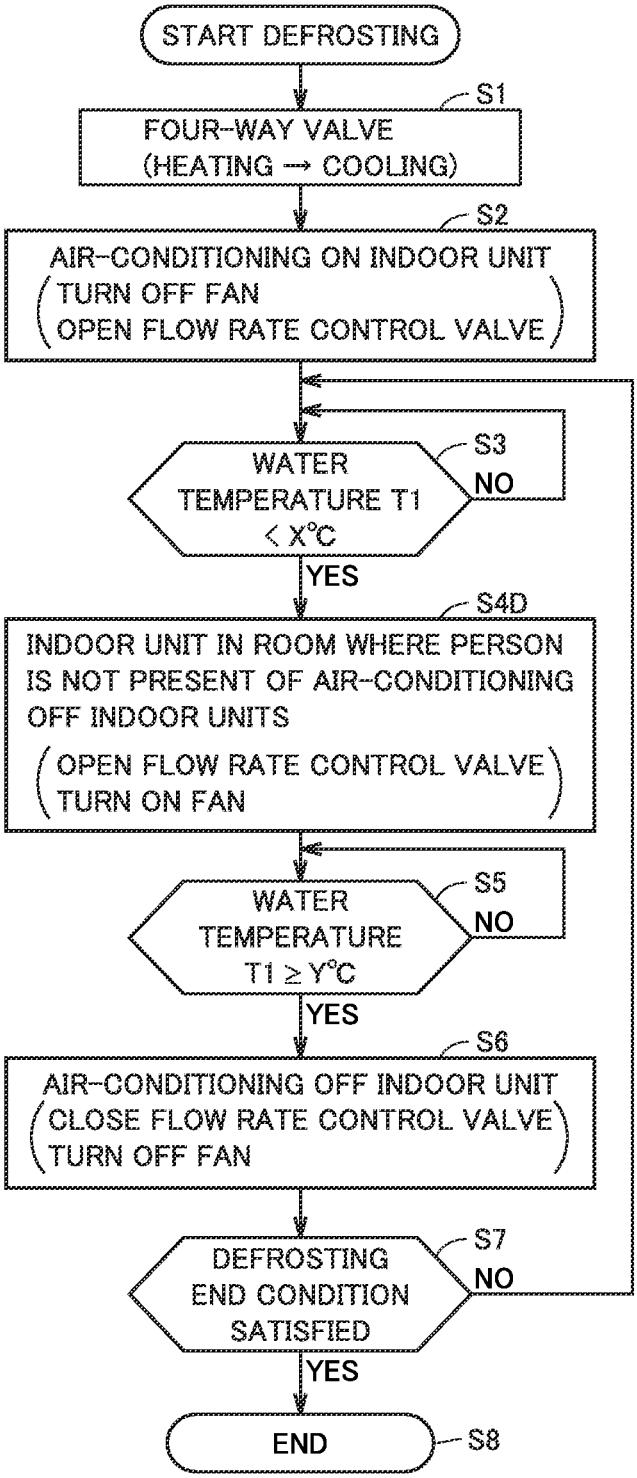
FIG. 14 is a flowchart for illustrating control performed by the controller in the fifth embodiment.

FIG. 14 is a flowchart for illustrating control performed by the controller in the fifth embodiment. In the flowchart shown in FIG. 14, step S4 in the flowchart illustrating the control of the first embodiment shown in FIG. 7 is replaced by step S4D. Therefore, description other than step S4D has been given in the first embodiment, and is thus not repeated here.

When water temperature T1 falls below X° C. during defrosting operation (YES in S3), in step S4D, controller 100 controls an indoor unit in a room where a person is not present of the indoor units in the air-conditioning OFF state, such that its flow rate control valve is opened and its fan is turned on. This causes a change in the second heat medium, from flowing through both indoor units 40 and 50 in state B of FIG. 4, for example, to flowing through only one of them in the room where a person is not present.

If a person is present in the rooms where all of the indoor units are installed, an indoor unit to serve as a heat extraction source may be selected based on any of the priorities described in the second to fourth embodiments.

As described above, in the fifth embodiment, air conditioning apparatus 1D further includes the plurality of human detection sensors 35, 45 and 55 installed at the locations where the plurality of third heat exchangers 31, 41 and 51 are installed. Controller 100 assigns a higher priority to a flow rate control valve corresponding to a human detection sensor not detecting a person of the plurality of human detection sensors 35, 45 and 55, than to a flow rate control valve corresponding to a human detection sensor detecting a person of the plurality of human detection sensors 35, 45 and 55.

As a result, the defrosting time can be shortened while the effect on the user is minimized.

Sixth Embodiment

In the embodiments above, controller 100 determines the priorities and selects an indoor unit to serve as a heat extraction source during defrosting operation. When the priorities are automatically determined, however, it is possible that the priorities may not reflect the user's intent. In a sixth embodiment, therefore, a priority setting mode is provided to allow the user to set priorities.

Figure 15:
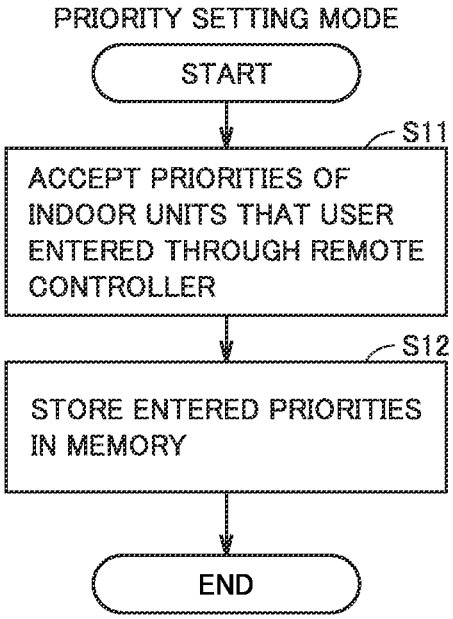
FIG. 15 is a flowchart for illustrating a process performed in a priority setting mode in a sixth embodiment.

FIG. 15 is a flowchart for illustrating a process performed in the priority setting mode in the sixth embodiment. The process of the flowchart in FIG. 15 is performed when the user selects the priority setting mode with a remote controller. In the priority setting mode, in step S11, controller 100 accepts priorities of the indoor units that the user entered through the remote controller. The user can freely set the priorities of the indoor units in an order that the generation of cold air and the like due to heat extraction can be tolerated in the air-conditioning OFF state during defrosting operation.

Then, in step S12, controller 100 stores the entered priorities in memory 103 of FIG. 6, and ends the process in the priority setting mode.

Figure 16:
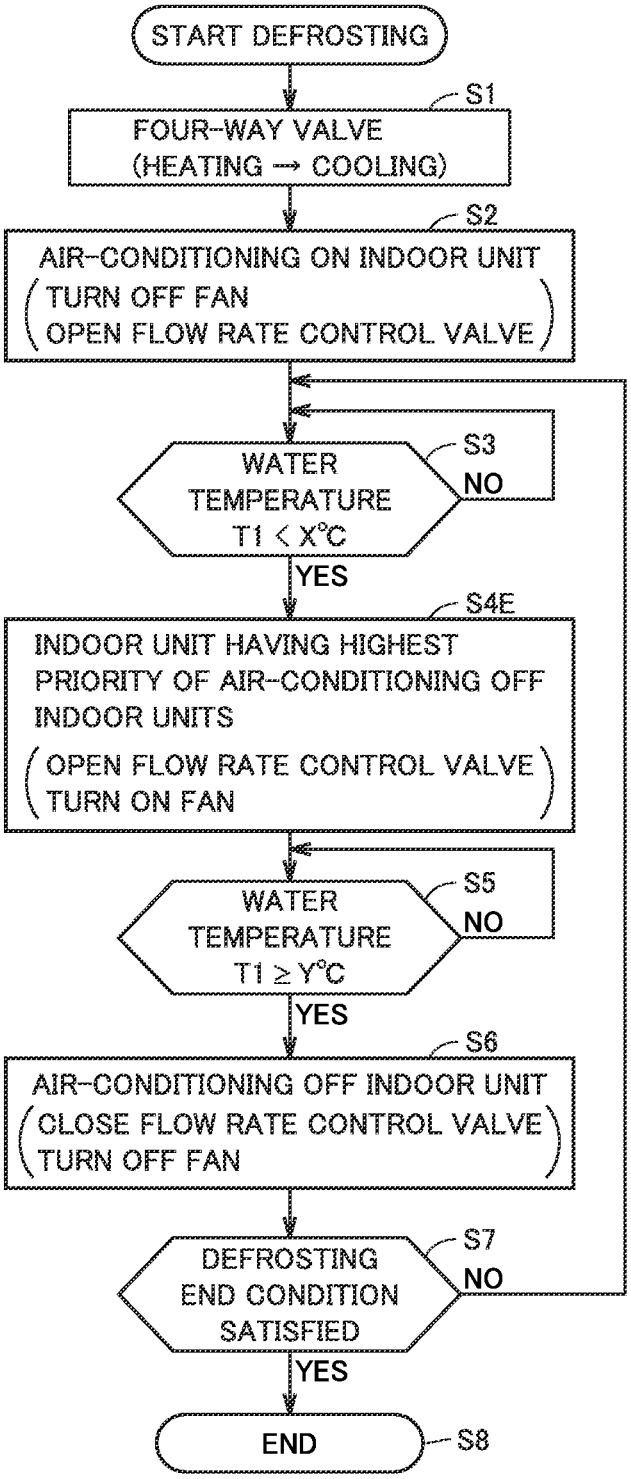
FIG. 16 is a flowchart for illustrating control performed by the controller in the sixth embodiment.

FIG. 16 is a flowchart for illustrating control performed by the controller in the sixth embodiment. In the flowchart shown in FIG. 16, step S4 in the flowchart illustrating the control of the first embodiment shown in FIG. 7 is replaced by step S4E. Therefore, description other than step S4E has been given in the first embodiment, and is thus not repeated here.

When water temperature T1 falls below X° C. during defrosting operation (YES in S3), in step S4E, controller 100 controls an indoor unit having the highest priority of the indoor units in the air-conditioning OFF state, such that its flow rate control valve is opened and its fan is turned on. This causes a change in the second heat medium, from flowing through both indoor units 40 and 50 in state B of FIG. 4, for example, to flowing through only one of them assigned with a higher priority.

As described above, in the sixth embodiment, air conditioning apparatus 1 further includes input device 201 through which the user sets the priorities. Controller 100 includes memory 103 to store the priorities set by the user.

The heat extracting process during the defrosting operation based on the priorities set by the user as described in the sixth embodiment may be combined with the processes of the second to fifth embodiments. In that case, it is preferred to perform the process of the sixth embodiment preferentially, and to perform the processes of the second to fifth embodiments when the user has not set the priorities, in order to allow modification of the priorities if they do not comply with the user's wish.

Seventh Embodiment

In the third to sixth embodiments described above, extracting of heat from an indoor unit installed in a room where a person is likely to be present is avoided based on the priorities for heat extraction during defrosting. In a seventh embodiment, a temporal difference is provided between driving of a flow rate control valve and driving of a fan, in order to avoid the generation of cold air as much as possible during defrosting operation.

Figure 17:
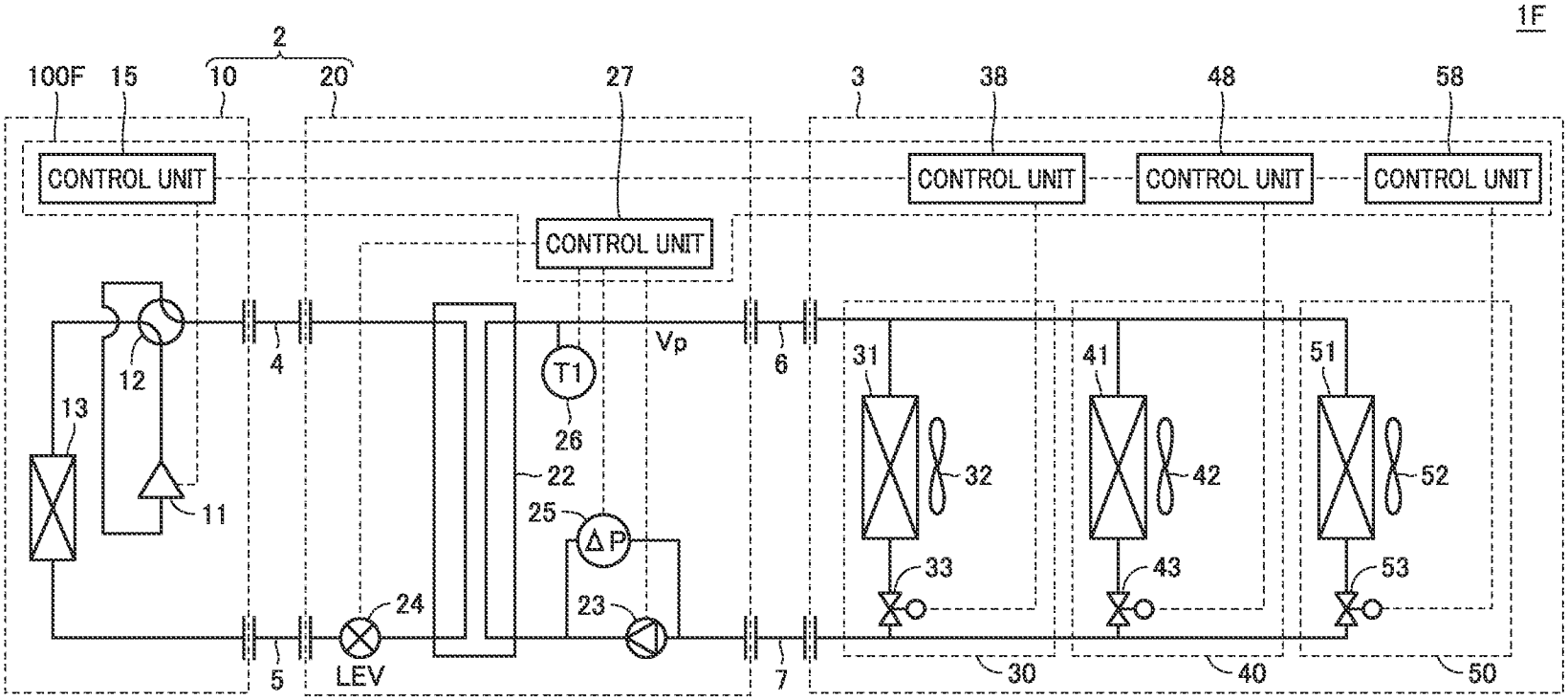
FIG. 17 is a diagram showing the configuration of an air conditioning apparatus 1F in a seventh embodiment.

FIG. 17 is a diagram showing the configuration of an air conditioning apparatus 1F in the seventh embodiment. Air conditioning apparatus 1F shown in FIG. 17 includes a controller 100F instead of controller 100 in the configuration of air conditioning apparatus 1 shown in FIG. 1.

Controller 100F includes a control unit 15 to control outdoor unit 10, a control unit 27 to control branch unit 20, and control units 38, 48 and 58 to control indoor units 30, 40 and 50, respectively.

Control units 38, 48 and 58 are configured to accumulate defrosting times of indoor units 30, 40 and 50, respectively. The configuration of air conditioning apparatus 1F is otherwise similar to that of air conditioning apparatus 1 shown in FIG. 1, and is not described repeatedly.

Figure 18:
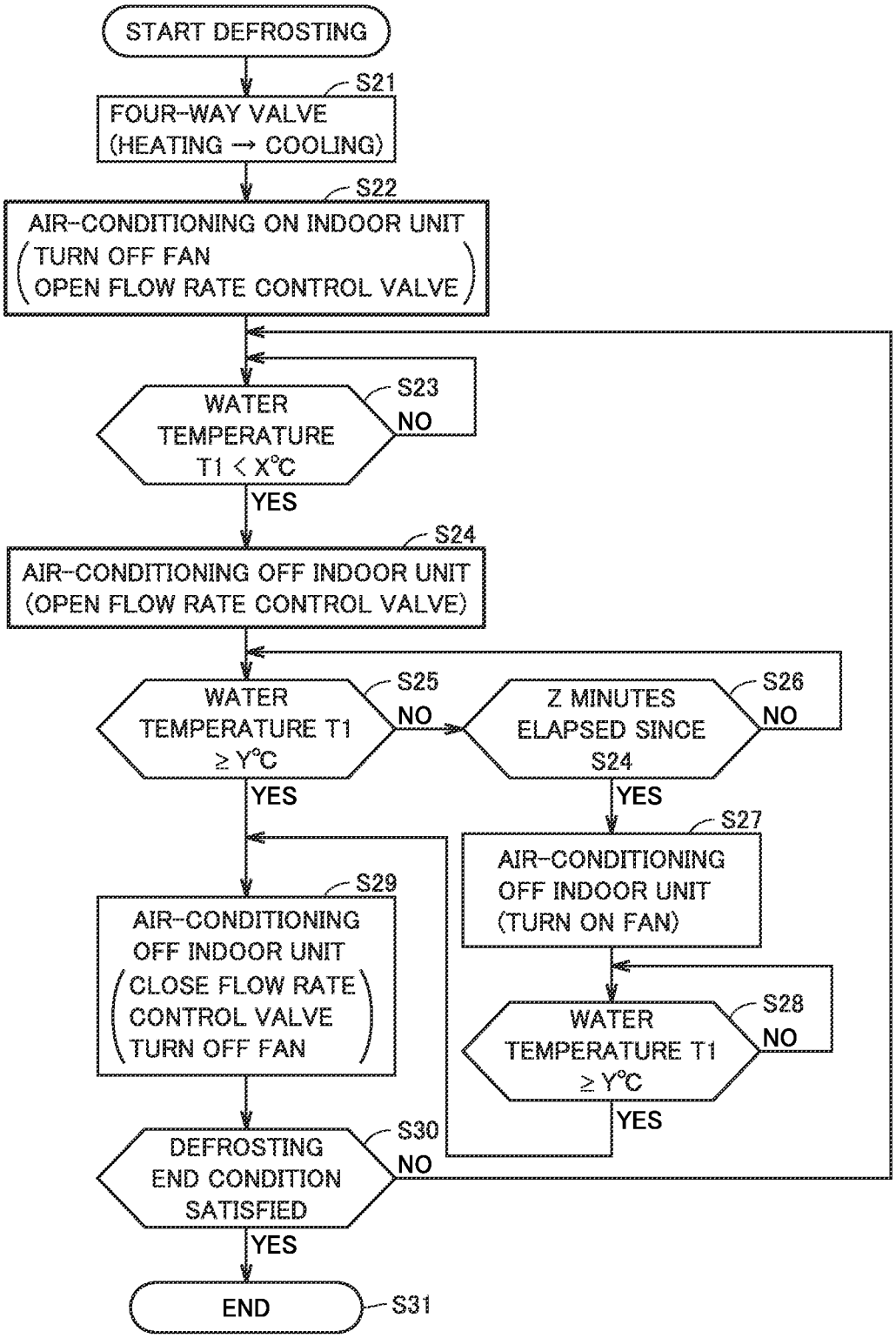
FIG. 18 is a flowchart for illustrating control performed during defrosting operation in the seventh embodiment.

FIG. 18 is a flowchart for illustrating control performed during defrosting operation in the seventh embodiment. The process of the defrosting operation shown in FIG. 18 is started when a predetermined defrosting start condition is satisfied. The defrosting start condition is satisfied, for example, each time a certain time elapses, or when the formation of frost on the heat exchanger of the outdoor unit is detected, during heating operation.

When the defrosting operation is started, first in step S21, controller 100 switches four-way valve 12 from a heating operation state to a cooling operation state. Subsequently, in step S22, controller 100 controls an indoor unit in the air-conditioning ON state such that its fan is turned off and its flow rate control valve is opened. This causes the second heat medium to flow as shown in FIG. 3, for example.

In this state, in step S23, controller 100 determines whether or not temperature T1 of the second heat medium detected at temperature sensor 26 is lower than first determination temperature X° C. When temperature T1 is higher than or equal to first determination temperature X° C. (NO in S23), the state of the defrosting operation shown in FIG. 3 is maintained. When temperature T1 is lower than first determination temperature X° C. (YES in S23), on the other hand, the process proceeds to step S24.

In step S24, controller 100 controls an air-conditioning OFF and fan OFF indoor unit such that its flow rate control valve is opened. At this time, however, its fan is maintained in the OFF state. Here, as described in the first to sixth embodiments, a flow rate control valve of an indoor unit having a high priority of the air-conditioning OFF and fan OFF indoor units may be opened, and a flow rate control valve of an indoor unit having a low priority may not be opened.

Further, in step S25, controller 100 determines whether or not temperature T1 of the second heat medium detected at temperature sensor 26 is higher than or equal to second determination temperature Y° C. Second determination temperature Y° C. may be any temperature higher than or equal to first determination temperature X° C. While second determination temperature Y° C. may be the same temperature as first determination temperature X° C., it is preferred to set Y>X to avoid frequent occurrence of switching of the flow path.

When temperature T1 is lower than second determination temperature Y° C. in step S25 (NO in S25), in step S26, it is determined whether or not a time of Z minute(s) has elapsed since the execution of the process of step S24. The time accumulated in any of control units 38, 48 and 58 is used for this determination. When Z minutes have not yet elapsed in step S26 (NO in S26), the determination process of step S25 is performed again. When Z minutes have elapsed in step S26 (YES in S26), on the other hand, the process proceeds to step S27.

In step S27, a fan corresponding to the indoor unit whose flow rate control valve was opened in step S24 is also turned on. As a result, heat exchange is actively performed between the indoor air and the second heat medium at the heat exchanger. The amount of heat extraction in the indoor unit thereby increases despite cold air being blown into the room, thus facilitating an increase in temperature of the second heat medium. Subsequently, in step S28, controller 100 determines whether or not temperature T1 of the second heat medium detected at temperature sensor 26 is higher than or equal to second determination temperature Y° C.

When temperature T1 is lower than second determination temperature Y° C. in step S28 (NO in S28), the determination process of step S28 is performed again.

When temperature T1 is higher than or equal to second determination temperature Y° C. in step S28 (YES in S28), on the other hand, the process proceeds to step S29. When temperature T1 is higher than or equal to second determination temperature Y° C. in step S25 (YES in S25), the process also proceeds to step S29.

In step S29, controller 100 controls the indoor unit in the air-conditioning OFF state such that its flow rate control valve is closed and its fan is turned off. This causes the flow of the second heat medium to return to the original state as shown in FIG. 3.

In subsequent step S30, controller 100 determines whether or not a defrosting end condition is satisfied. The defrosting end condition is satisfied, for example, when a certain time has elapsed since the start of the defrosting, or when the defrosting of the outdoor unit is completed. When the defrosting end condition is not satisfied in step S30, the processes of step S23 and the subsequent steps are repeated again. When the defrosting end condition is satisfied in step S30, on the other hand, the defrosting operation ends in step S31, and the heating operation is performed again.

Figure 19:
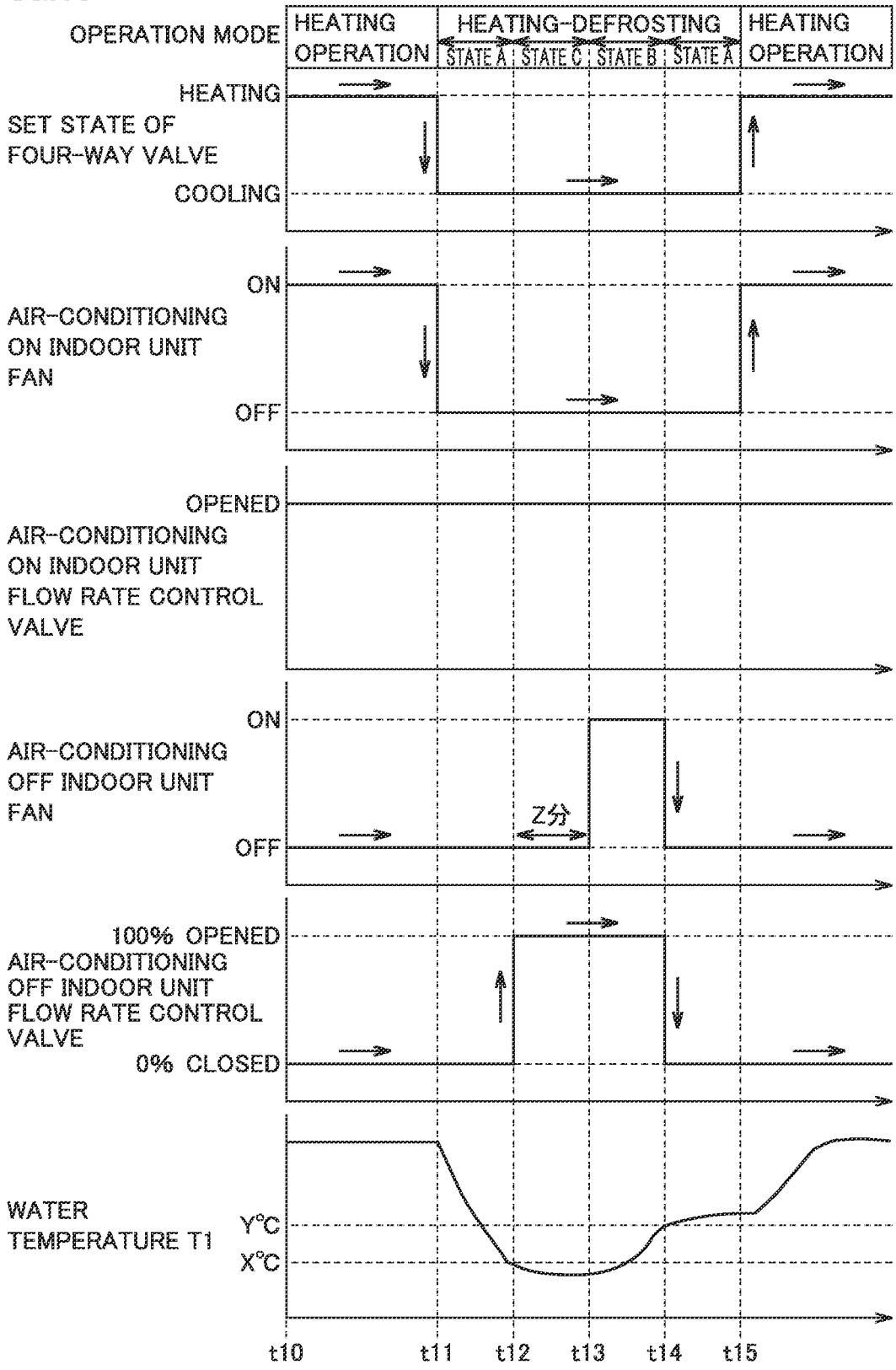
FIG. 19 shows waveform diagrams for illustrating exemplary control of heating-defrosting operation performed in the seventh embodiment.

FIG. 19 shows waveform diagrams for illustrating exemplary control of the heating-defrosting operation performed in the seventh embodiment. Between times t10 and t11 in FIG. 19, heating operation is performed, and the first heat medium and the second heat medium flow as shown in FIG. 2.

At time t11, in response to a heating-defrosting start condition being satisfied, the state of the four-way valve is set from a heating state to a cooling state. Between times t11 and t12, the first heat medium and the second heat medium flow as shown in state A of FIG. 3. The heat of the second heat medium is transferred to the first heat medium at second heat exchanger 22, causing the temperature of the second heat medium to decrease gradually, and fall below first determination temperature X° C. at time t12.

In response to this, between times t12 and t13, the flow of the second heat medium is changed such that the second heat medium also flows through an air-conditioning OFF indoor unit serving as a heat extraction source as shown in FIG. 4. At this time, however, its fan is maintained in the OFF state. This state is referred to as a state C.

At time t13 when Z minutes have elapsed since time t12, water temperature T1 is still lower than Y° C., and therefore, controller 100F turns on the fan of the air-conditioning OFF indoor unit serving as a heat extraction source. This state is state B similar to that in the first embodiment. The indoor air and the second heat medium thereby exchange a greater amount of heat with each other, causing the temperature of the second heat medium to increase gradually.

When the temperature of the second heat medium becomes higher than second determination temperature Y° C. at time t14, the settings of the flow rate control valves are changed again, and the fan of the indoor unit serving as a heat extraction source is also returned to the OFF state, as shown in FIG. 3. Then, when a defrosting operation stop condition is satisfied at time t15, a return is made again to the heating operation as shown in FIG. 2.

As described above and shown in FIGS. 17 to 19, when the temperature of the second heat medium is still lower than the second determination temperature after the determination time has elapsed since the opening of a part having a high priority (for example, one having the highest priority) of the flow rate control valves corresponding to the heat exchangers that are not being requested to perform air conditioning, controller 100F causes rotation of the fan of the indoor unit corresponding to the opened flow rate control valve.

By controlling the flow rate control valve and the fan of the indoor unit serving as a heat extraction source in this manner, when temperature T1 of the second heat medium becomes higher than second determination temperature Y° C. within Z minutes, the defrosting operation can be completed without rotation of the fan. Therefore, situations such as where cold air is blown from the air-conditioning OFF indoor unit can be reduced.

With such control, in the air conditioning apparatus of the seventh embodiment, when the temperature of the second heat medium decreases during defrosting operation, the flow rate control valve of the indoor unit in the air-conditioning OFF state is opened, and if the amount of heat extraction is not enough, the fan is also rotated to increase the temperature of the second heat medium. This allows fine control of the amount of heat extracted from the indoor unit, thus requiring only a necessary amount of heat extraction, which is also advantageous when the indoor unit in the air-conditioning OFF state starts heating.

It should be understood that the embodiments disclosed herein are illustrative and non-restrictive in every respect. The scope of the present disclosure is defined by the terms of the claims, rather than the description of the embodiments above, and is intended to include any modifications within the meaning and scope equivalent to the terms of the claims.

The invention claimed is:

1. A controller that controls an air conditioning apparatus configured to operate in operation modes including a heating mode and a defrosting mode, the air conditioning apparatus comprising:

a compressor configured to compress a first heat medium;

a first heat exchanger configured to perform heat exchange between the first heat medium and outdoor air;

a second heat exchanger configured to perform heat exchange between the first heat medium and a second heat medium;

a plurality of third heat exchangers each configured to perform heat exchange between the second heat medium and indoor air;

a plurality of flow rate control valves each configured to control a flow rate of the second heat medium flowing through a corresponding one of the plurality of third heat exchangers; and a pump configured to circulate the second heat medium between the plurality of third heat exchangers and the second heat exchanger, wherein in the heating mode, the controller is configured to open a flow rate control valve corresponding to a heat exchanger that is being requested to perform air conditioning of the plurality of third heat exchangers, and to close a flow rate control valve corresponding to a heat exchanger that is not being requested to perform air conditioning of the plurality of third heat exchangers, and in the defrosting mode, when a temperature of the second heat medium is lower than a first determination temperature, the controller is configured to open a flow rate control valve corresponding to at least one of the heat exchangers that are not being requested to perform air conditioning, the at least one of the heat exchangers being assigned a higher priority than a remaining heat exchanger that is not being requested to perform air conditioning.

2. The controller according to claim 1, wherein the air conditioning apparatus further comprises a plurality of room temperature sensors, each of which is installed at a location where a corresponding one of the plurality of third heat exchangers is installed, and the controller is configured to assign a higher priority to a flow rate control valve as a temperature detected by a corresponding one of the plurality of room temperature sensors is higher.

3. The controller according to claim 1, wherein the controller is configured to assign a higher priority to a flow rate control valve as a capability of a corresponding one of the plurality of third heat exchangers is higher.

4. The controller according to claim 1, wherein the controller is configured to assign a higher priority to a flow rate control valve as operation hours of a corresponding one of the plurality of third heat exchangers during a certain period of time prior to a present time are shorter.

5. The controller according to claim 4, wherein the controller is configured to assign a higher priority to a flow rate control valve as its corresponding operation hours per day on a same day of the week as a present day of the week are shorter.

6. The controller according to claim 1, wherein the air conditioning apparatus further comprises a plurality of human detection sensors, each of which is installed at a location where a corresponding one of the plurality of third heat exchangers is installed, and the controller is configured to assign a higher priority to a flow rate control valve corresponding to a human detection sensor not detecting a person of the plurality of human detection sensors, than to a flow rate control valve corresponding to a human detection sensor detecting a person of the plurality of human detection sensors.

7. The controller according to claim 1, wherein the air conditioning apparatus further comprises an input device through which a user sets priorities, and the controller includes a memory configured to store the priorities set by the user.

8. The controller according to claim 1, wherein when the temperature of the second heat medium is still lower than a second determination temperature after a determination time has elapsed since the opening of the flow rate control valve corresponding to the at least one of the heat exchangers that are not being requested to perform air conditioning, the controller is configured to cause rotation of a fan of an indoor unit corresponding to the opened flow rate control valve.

9. An outdoor unit comprising:

the compressor;

the first heat exchanger; and the controller according to claim 1.

10. A branch unit comprising:

the second heat exchanger;

the pump; and the controller according to claim 1.

11. A heat source unit comprising:

the compressor;

the first heat exchanger;

the second heat exchanger;

the pump; and the controller according to claim 1.

12. An air conditioning apparatus comprising:

a first heat medium circuit formed by the compressor, the first heat exchanger, and the second heat exchanger;

a second heat medium circuit formed by the pump, the second heat exchanger, and the plurality of third heat exchangers; and the controller according to claim 1.

* * * * *